US009704332B2

(12) United States Patent
Guerrero

(10) Patent No.: US 9,704,332 B2
(45) Date of Patent: Jul. 11, 2017

(54) WAGERING GAME AND METHOD HAVING ADDITIONAL REEL MATRICES SHARING A COMMON REEL

(71) Applicant: Bally Gaming, Inc., Las Vegas, NV (US)

(72) Inventor: Christopher K. Guerrero, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 339 days.

(21) Appl. No.: 14/492,320

(22) Filed: Sep. 22, 2014

(65) Prior Publication Data

US 2015/0087392 A1 Mar. 26, 2015

Related U.S. Application Data

(60) Provisional application No. 61/881,210, filed on Sep. 23, 2013.

(51) Int. Cl.
*G07F 17/32* (2006.01)
*G07F 17/34* (2006.01)

(52) U.S. Cl.
CPC ..... *G07F 17/3213* (2013.01); *G07F 17/34* (2013.01)

(58) Field of Classification Search
USPC ..... 463/20
See application file for complete search history.

(56) References Cited

U.S. PATENT DOCUMENTS

| | | | | |
|---|---|---|---|---|
| 2015/0080094 | A1* | 3/2015 | Edwards | G07F 17/326 463/20 |
| 2015/0080098 | A1* | 3/2015 | Nicely | G07F 17/34 463/20 |
| 2016/0364945 | A1* | 12/2016 | Zoltewicz | G07F 17/326 |
| 2017/0024972 | A1* | 1/2017 | Saunders | G07F 17/34 |

* cited by examiner

*Primary Examiner* — Pierre E Elisca
(74) *Attorney, Agent, or Firm* — Philip J. Anderson; Marvin A. Hein

(57) ABSTRACT

Disclosed are a game, gaming device, system and method for play of a reel-based feature game including a base matrix of reel indicia, one or more additional matrices of reel indicia and an expanding reel which replaces a portion of the base matrix and each of the additional reel matrices to simultaneously produce outcomes in each of the matrices.

6 Claims, 20 Drawing Sheets

100

WAGERING GAME AND METHOD HAVING ADDITIONAL REEL MATRICES SHARING A COMMON REEL

RELATED APPLICATIONS

This application is a non-provisional application of U.S. Provisional Application 61/881,210 filed Sep. 23, 2013, hereby incorporated by reference in its entirety for all purposes.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

1. Field of the Invention

The present invention is directed to wagering games, gaming machines, networked gaming systems and methods and, more particularly, to wagering games, gaming machines, networked gaming systems and methods having multiple reel sets sharing a common reel.

2. the Prior Art

Gaming devices such as casino gaming devices, e.g. slot machines, have been popular for over a century. In general, a gaming machine allows a player to play a game in exchange for a wager. Depending on the outcome of the game, the player may be entitled to an award which is paid to the player by the gaming machine, normally in the form of currency or game credits. Gaming machines may include flashing displays, lighted displays, or sound effects to capture a player's interest in a gaming device.

Initially such devices were mechanical devices presenting one or more mechanical spinning reels to randomly select and display winning or losing outcomes at a single pay line. Today, such devices are computer controlled and some include video displays, electromechanical stepper controlled physical reels or combinations thereof. Typically these devices display game features of a base game and perhaps one or more bonus or secondary games. For example, for a video device, the game may present a base game depicting video images of five reels each with three display positions, i.e. coordinates producing a 3×5 matrix of positions for symbols. One or more pay lines are provided. Under control of the computer processor the video display depicts the reels spinning and stopping to arrange the game symbols in the matrix and where a predetermined winning combination of symbols is obtained on a wagered upon (i.e. enabled) pay line or pay arrangement the player receives a prize. Of course the foregoing description should not be deemed to be limiting since awards may be issued for symbols scattered in the matrix, i.e. a "scatter pay" and some symbols may trigger additional features such as a secondary game.

Some gaming machine games today include one or more progressive prize awards. In some configurations, the progressive prize may have a small probability of a player winning it; thus making it possible to have a larger progressive prize. In other game configurations, the progressive prize may be a small amount; thus allowing the player patron to win the progressive prize more frequently. In most typical game configurations, the player wins the progressive prize as a result of a specific game outcome within the primary or main game.

Another important feature of maintaining player interest in a gaming machine includes providing the player with many opportunities to win awards, such as cash or prizes. For example, in some slot machines, the display windows show more than one adjacent symbol on each reel, thereby allowing for multiple-line betting. Feature games of various types have been employed to reward players above the amounts normally awarded on a standard game pay schedule. Generally, such feature games are triggered by predetermined events such as one or more appearances of certain combinations of indicia in a primary game. In order to stimulate interest, feature games are typically set to occur at a gaming machine on a statistical cycle based upon the number of primary game plays. Feature games may include free spins of the base game, alteration of the base game for a number of spins, e.g. making one or more symbols wild or altering the symbol sets for the reels, a game where a player makes selections to reveal one or more prizes or otherwise interacts with a game feature to produce, or try to produce, an additional award. Often players play the games primarily to enjoy the excitement of these feature games. While gaming machines including feature games have been successful, there remains a need for new and exciting feature games.

BRIEF DESCRIPTION OF THE INVENTION

The present invention provides a game, gaming machine, system and method for initiating play of a feature game including a base reel matrix and one or more additional reel matrices sharing a common reel with the base reel matrix. In one or more embodiments, the common reel may be displayed as an enlarged reel spanning two or more reel columns of the base reel matrix and the one or more additional reel matrices, as will be illustrated and described below.

In accordance with one embodiment of the invention, a wagering game for a gaming device, the gaming device comprising a non-transitory memory device and a processor, the wagering game including a base game executed by the processor under control of instructions stored in the non-transitory memory device and comprising a first plurality of indicia-bearing reels which are spun or appear to spin to produce an outcome in a first game matrix and a feature game initiated upon a triggering event and comprising a second plurality of indicia-bearing reels which are spun or appear to spin to produce an outcome in a second game matrix. A single expanded reel replaces at least part of the first game matrix and the second game matrix and is spun or appears to spin to simultaneously produce an outcome in both the first game matrix and the second game matrix. In one or more embodiments, the feature game comprises a third matrix which is also partially replaced by the expanded reel, which, in turn, produces an outcome in the third matrix. In still other embodiments, the width of the expanded reel may be wider than the normal reel widths of the reels in the matrices.

The invention further relates to machine readable media on which are stored embodiments of the present invention. It is contemplated that any media suitable for retrieving instructions is within the scope of the present invention. By way of example, such media may take the form of magnetic, optical, or semiconductor media. The invention also relates to data structures that contain embodiments of the present invention, and to the transmission of data structures containing embodiments of the present invention.

Further advantages of the invention will be brought out in the following portions of the specification, wherein the detailed description is for the purpose of fully disclosing the preferred embodiment of the invention without placing limitations thereon.

BRIEF DESCRIPTION OF THE DRAWING

The present invention will be more fully understood by reference to the following drawings, which are for illustrative purposes only.

DETAILED DESCRIPTION OF THE PREFERRED EMBODIMENTS

Persons of ordinary skill in the art will realize that the following description of the present invention is illustrative only and not in any way limiting. Other embodiments of the invention will readily suggest themselves to such skilled persons having the benefit of this disclosure.

Figure 1A:
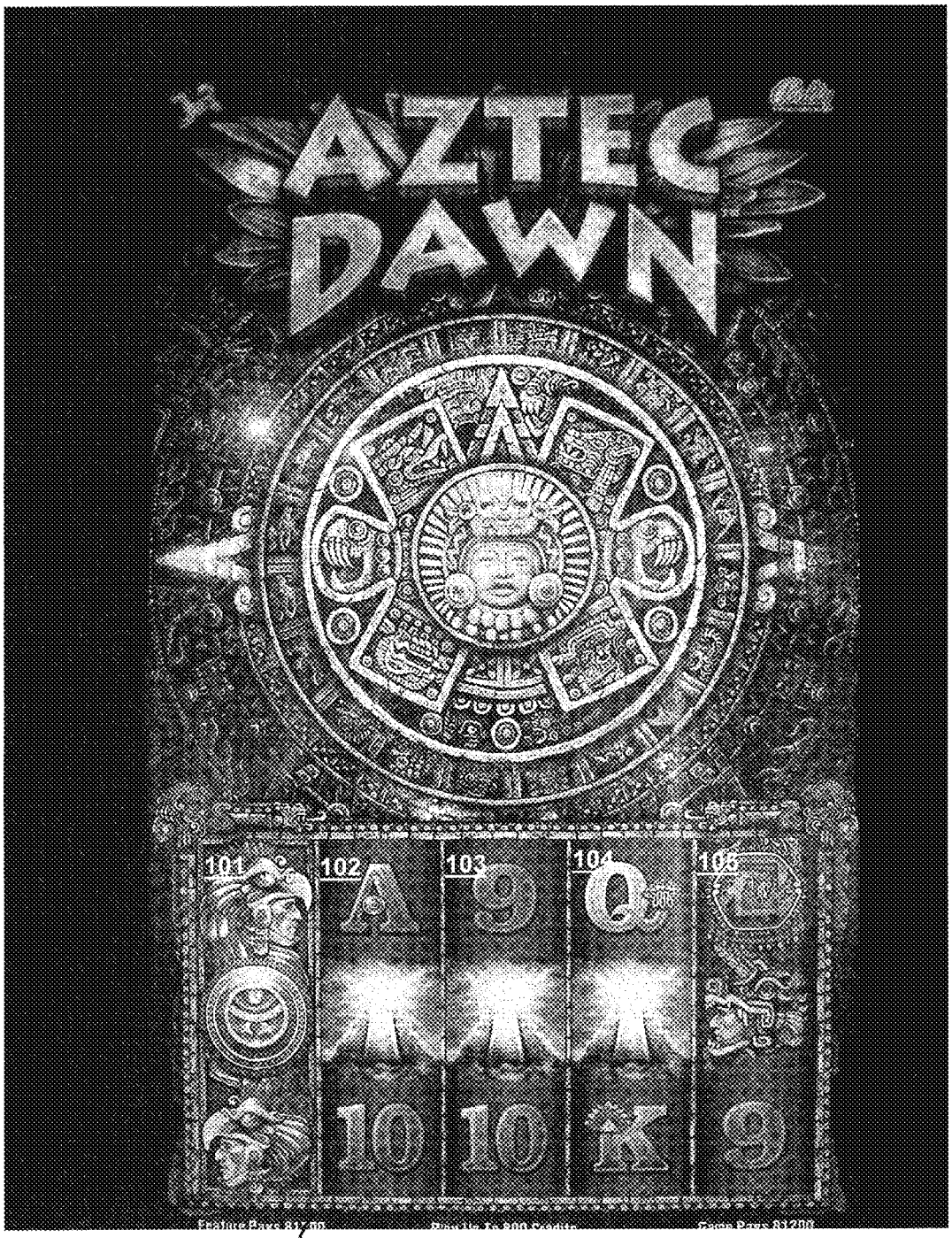
FIGS. 1A, 1B, 1C, 1D, 1E, 1F, 1G, 1H, 1I, 1J, 1K and 1L illustrate examples of game screens in accordance with one or more embodiments of the invention.

Referring to FIG. 1A, in accordance with one or more embodiments, a game screen displays a slot machine base game including five indicia-bearing spinning reels 101-105 with three rows of indicia visible per reel in a base game matrix 100. With each play of the base game, the reels spin and stop to display a subset of the indicia on the reels to produce an outcome for that particular play of the game.

Figure 1B:
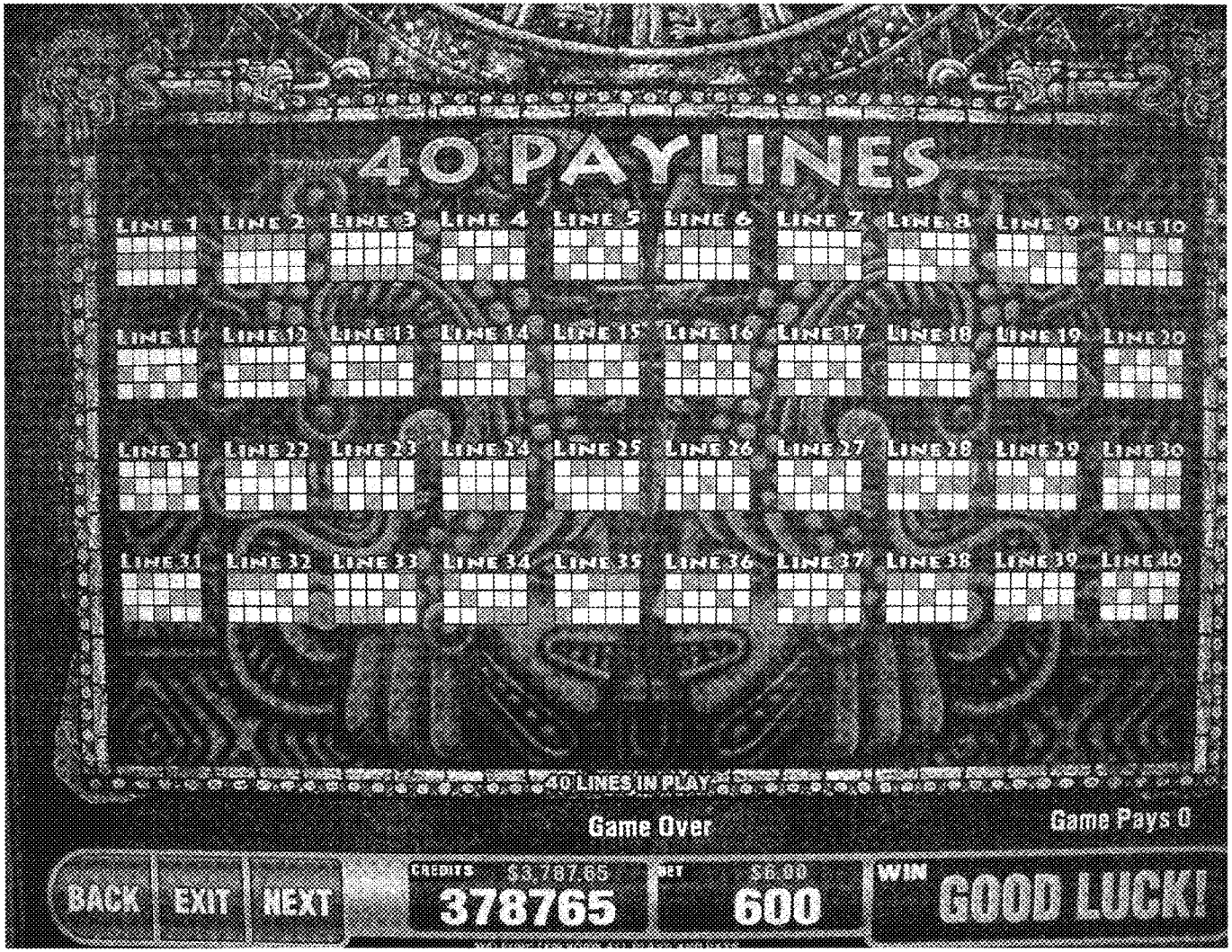
Figure 1C:
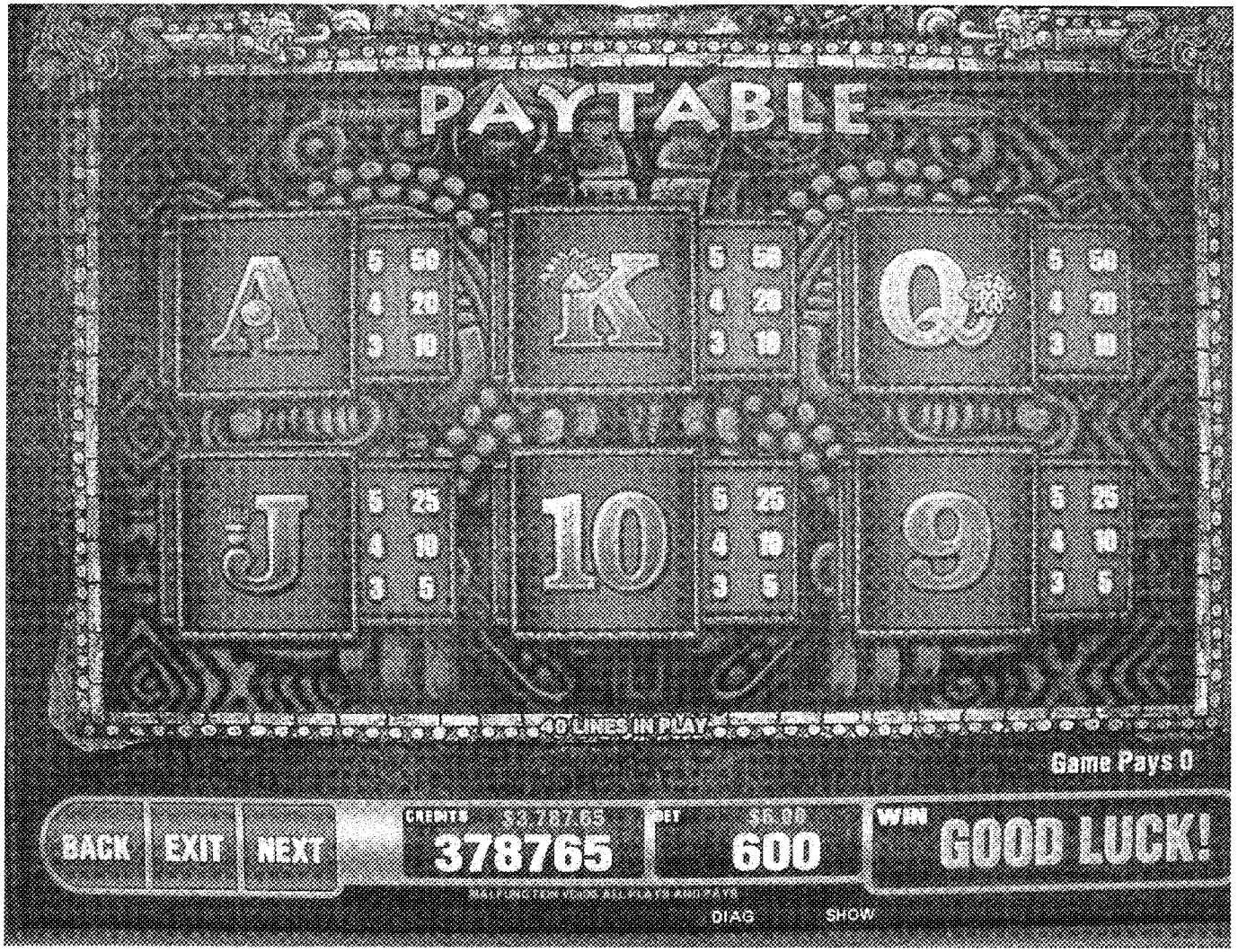

Referring to FIGS. 1B and 1C, in accordance with one or more embodiments, the displayed indicia of a particular game outcome are broken into subsets according to a series of pay line patterns. Prizes may be awarded to a player of the game by comparing the displayed game indicia in each of the pay line patterns with a pay table, as illustrated by FIG. 1C. When a pattern of indicia in the pay table matches a pattern of indicia on one of the pay lines, the corresponding prize may be awarded to the player. Other pay table rules, not shown but commonly known to those skilled in the art, may dictate other ways on which the player may be awarded prizes. For example, the player may be awarded a prize when one or more indicia appear "scattered" anywhere on the displayed outcome matrix.

Figure 1D:
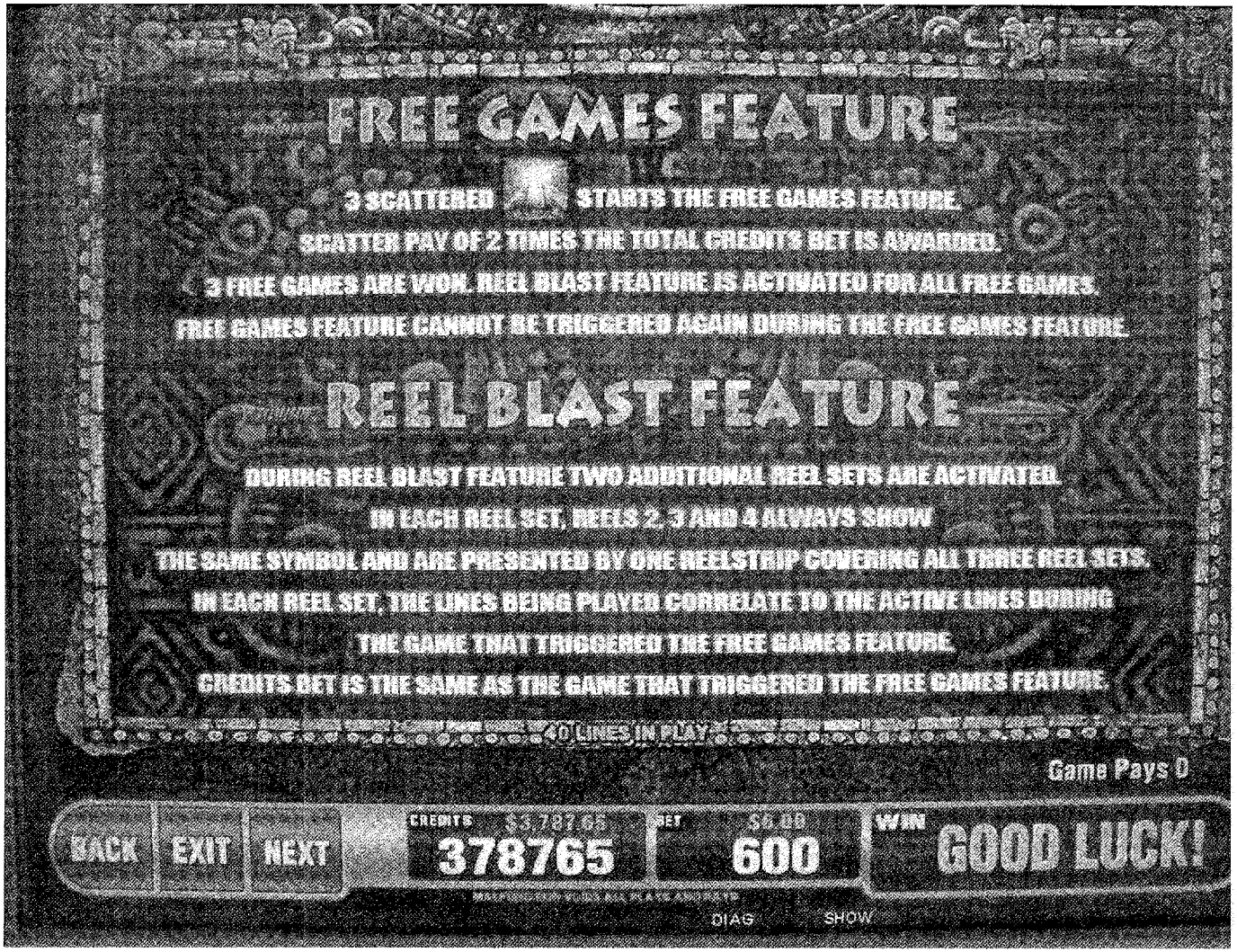

Referring to FIG. 1D, in accordance with one or more embodiments, certain pay line outcomes or other triggering conditions may trigger play of a feature game. For example, as illustrated in FIG. 1D, three "scattered" pyramid symbols award the player twice the amount of his wager and trigger the play of three free games. During the three free games, a Reel Blast™ feature is invoked. Two additional reel matrices are created. In accordance with some embodiments, the indicia on the reels of the base and additional matrices and/or their probability of appearance may or may not be modified during the free games. The number of rows and/or columns of the additional reel matrices may or may not be the same as the base game matrix. In the example described here, the matrices are the same size as the base game matrix.

Figure 1E:
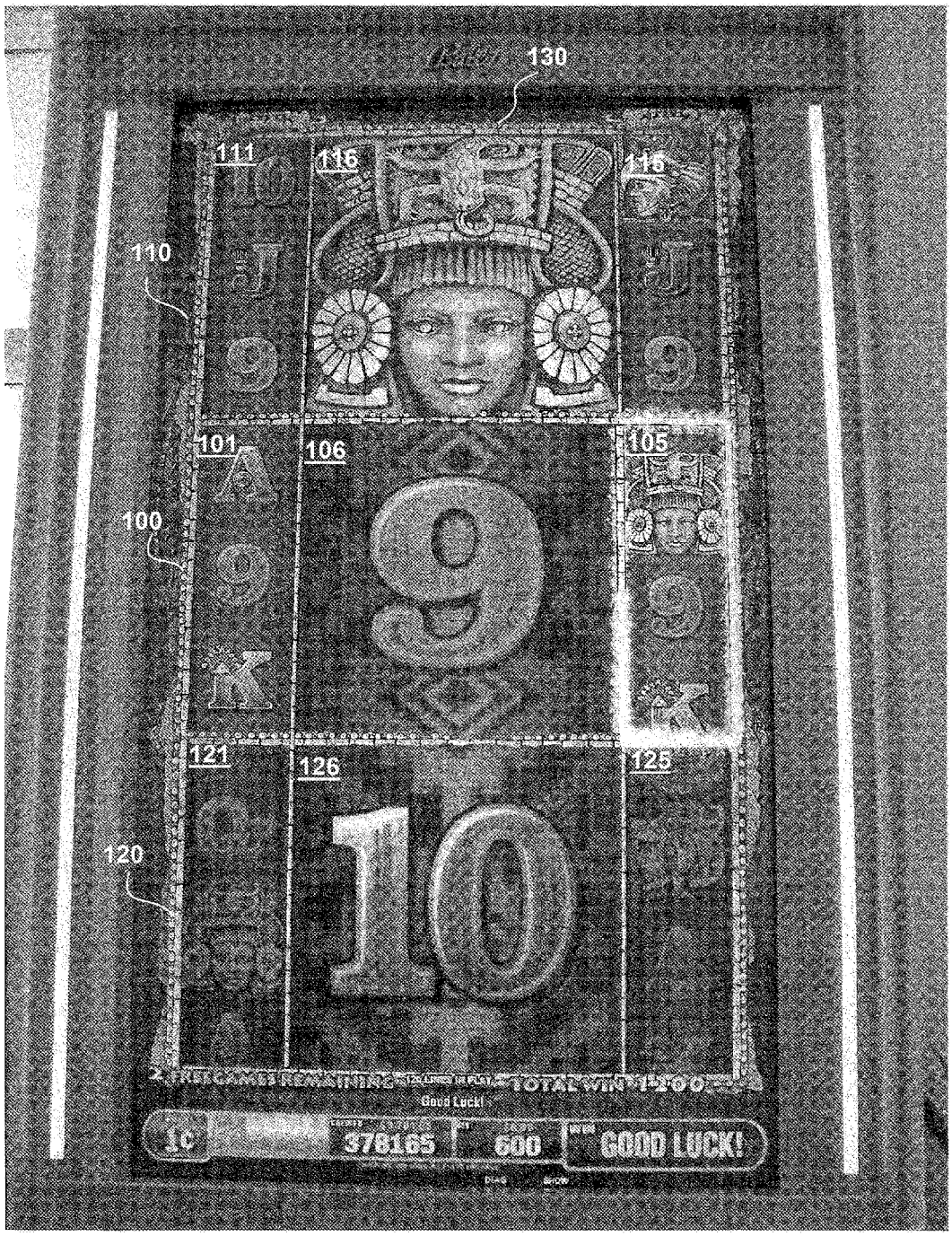
Figure 1F:
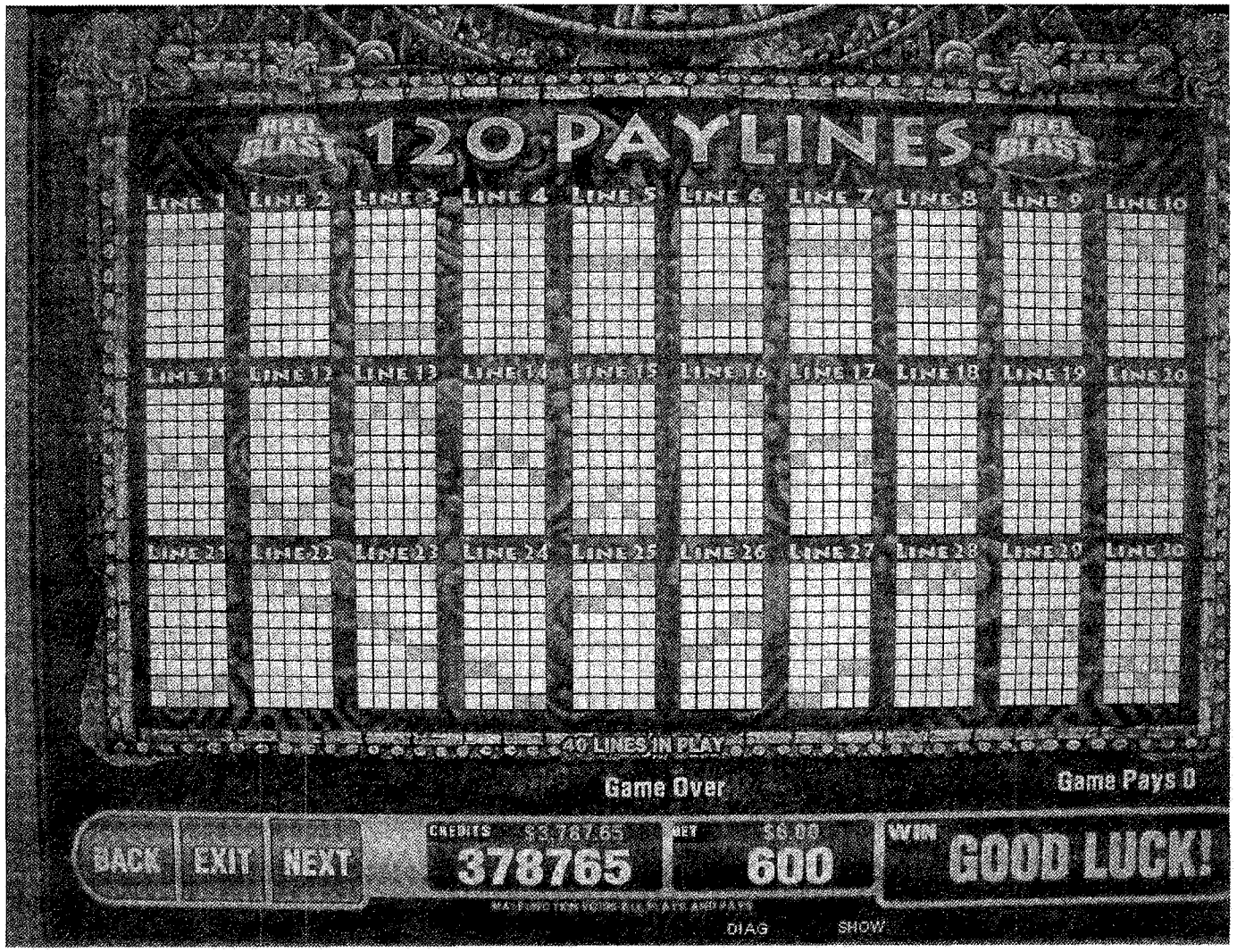
Figure 1G:
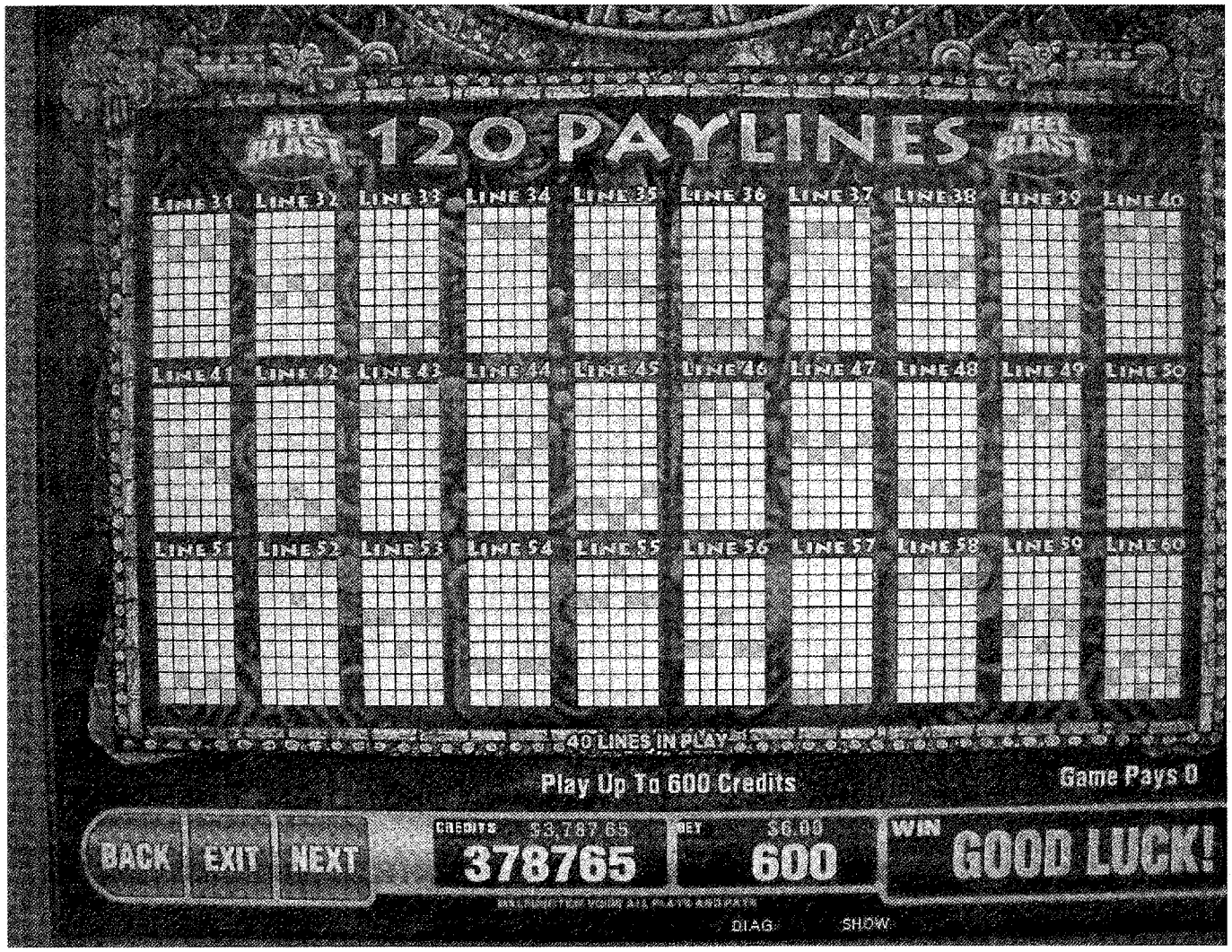
Figure 1H:
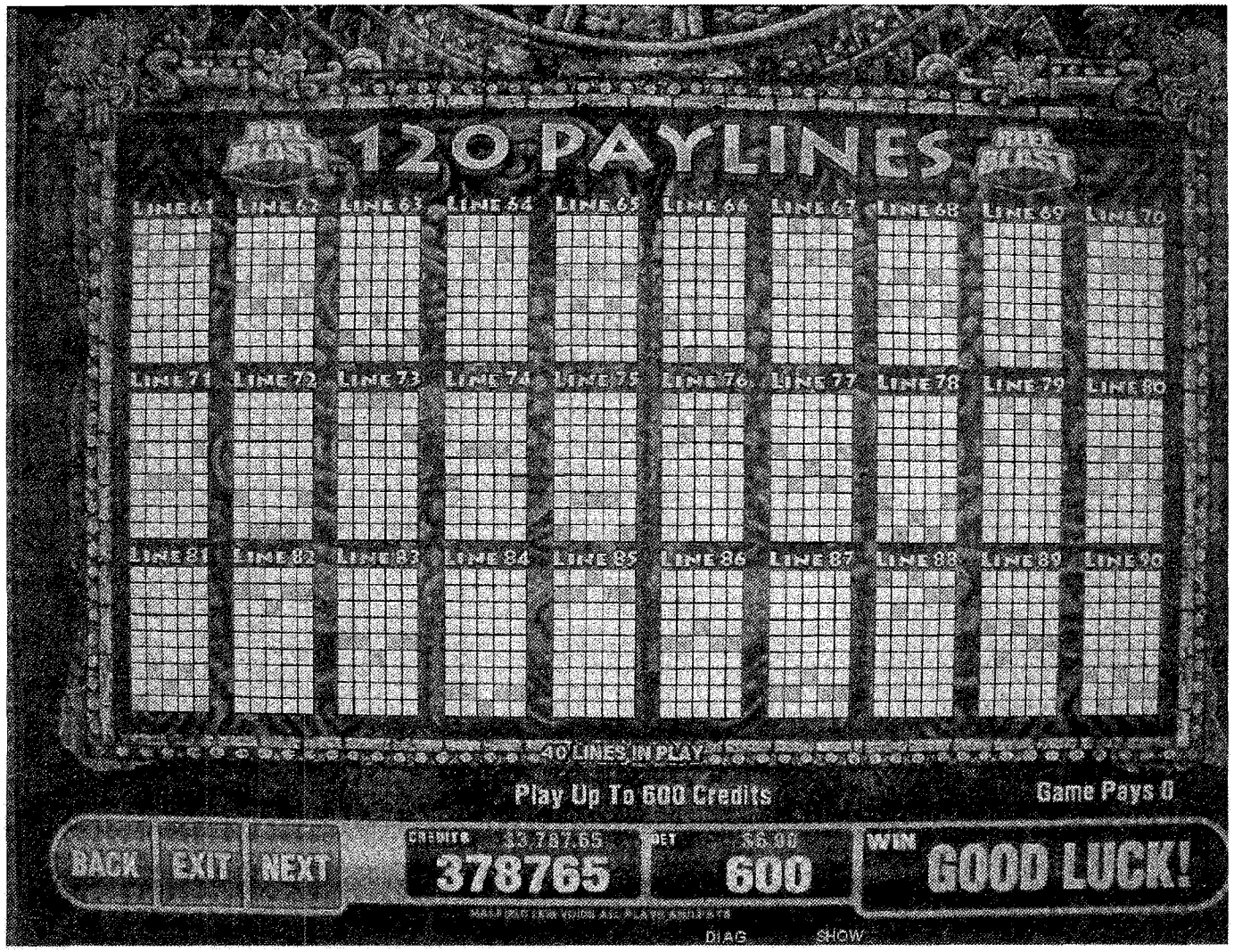
Figure 1I:
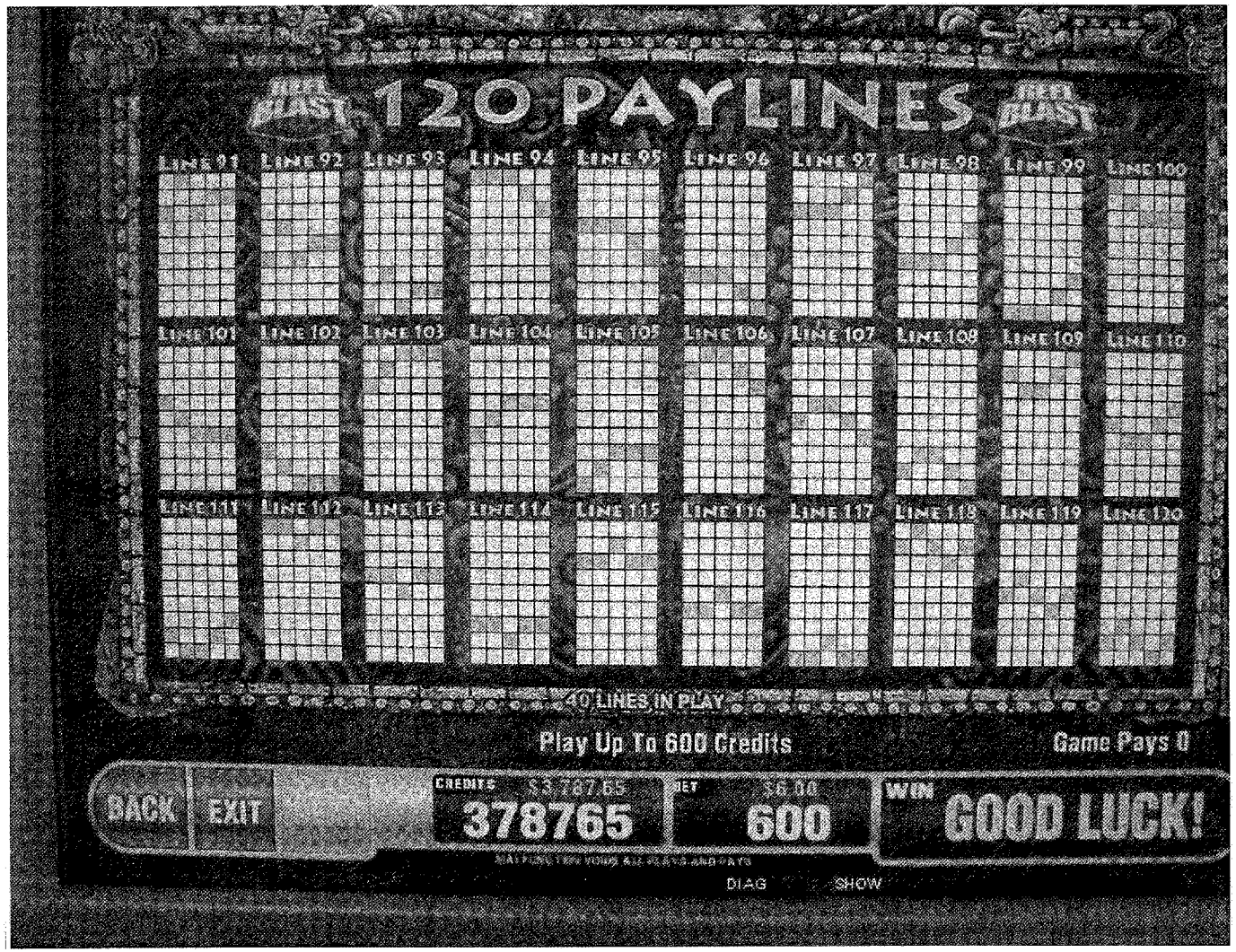

Referring to FIG. 1E, in accordance with at least the illustrated embodiment, the original base game matrix 100 now comprises reels 101 and 105, as originally illustrated in FIG. 1A, and an expanded reel position 106 which encompasses the portion of game matrix 100 previously occupied by reels 102-104.

Furthermore, as shown, one additional reel matrix 110 is presented above reel matrix 100 and comprises reel 111, an expanded reel position 116 and reel 115. An additional reel matrix 120 comprising reels 121, an expanded reel position 126 and reel 125 is also presented below reel matrix 100.

Figure 1J:
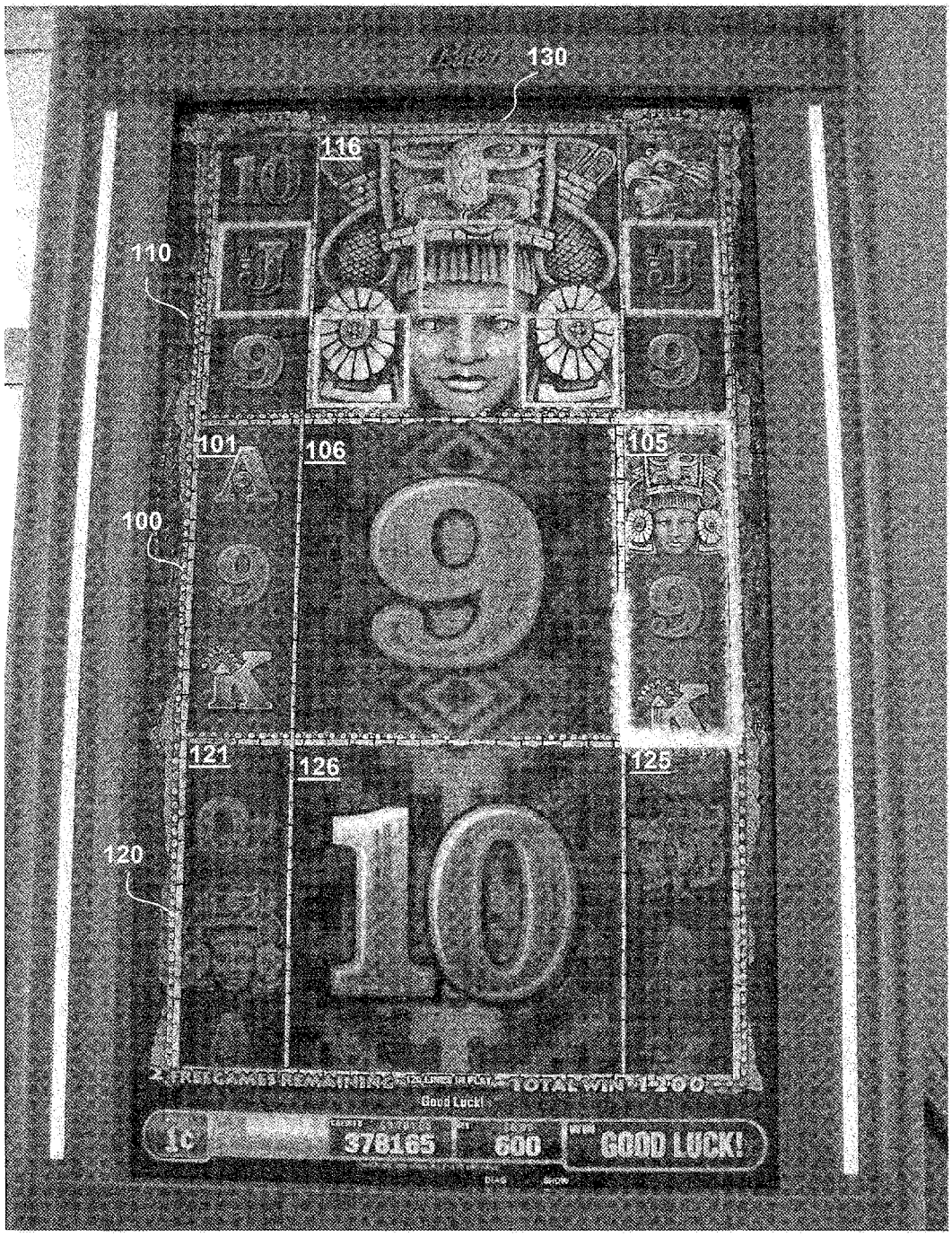
Figure 1K:
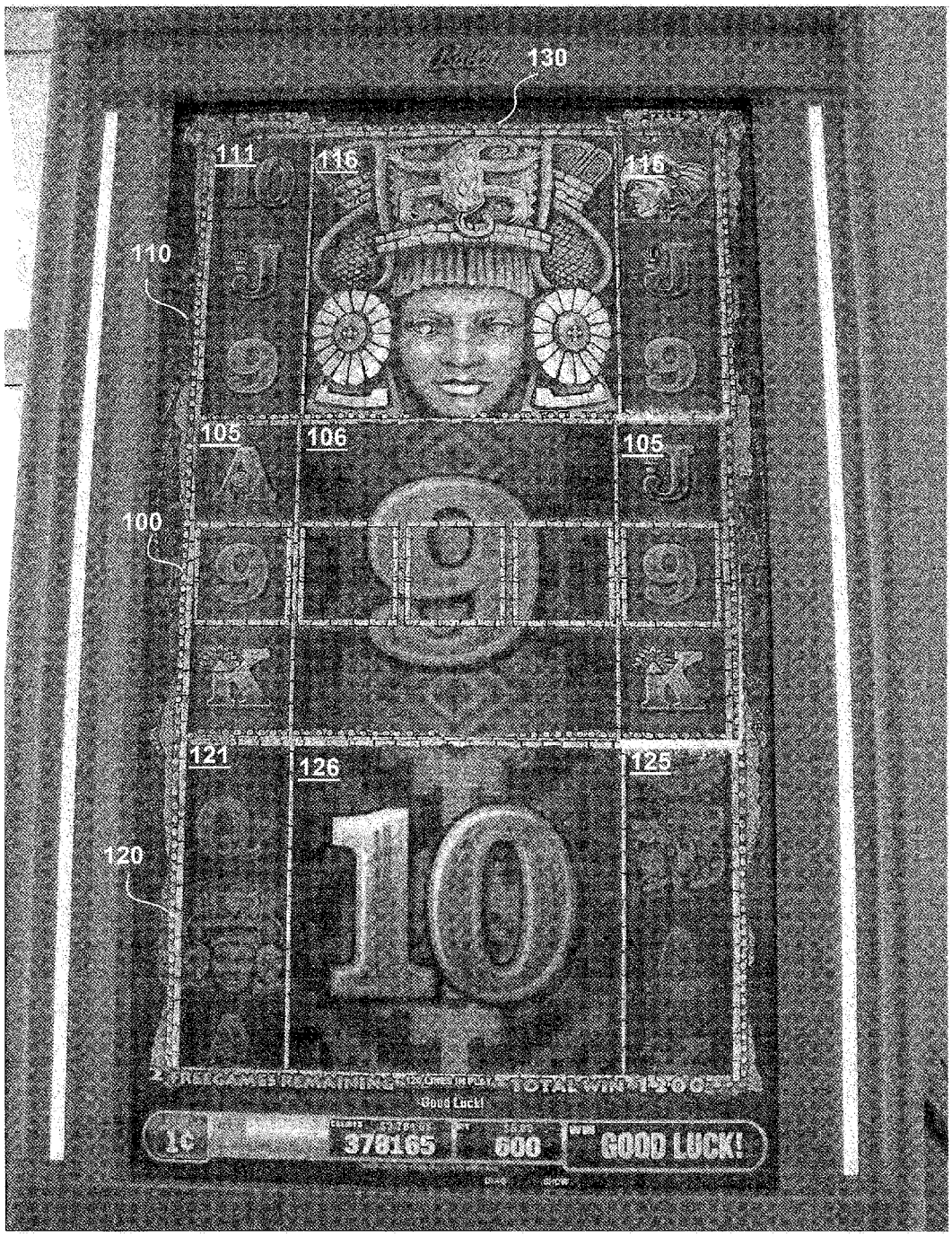
Figure 1L:
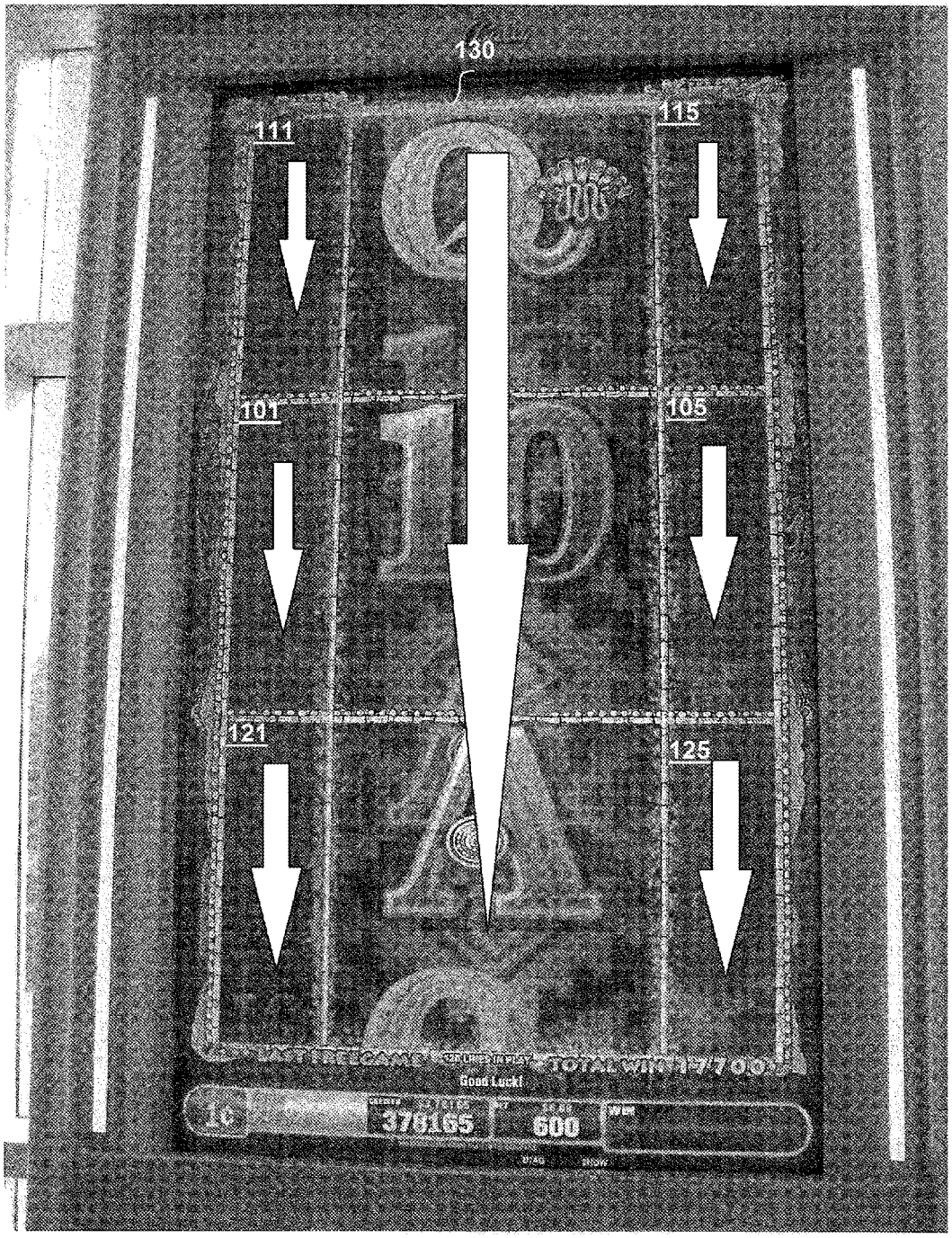

Referring to FIG. 1L, in accordance with one or more embodiments, reels 111 and 121 spin independently of reel 101 and each other. Reels 115 and 125 spin independently of reel 105 and each other. Expanded reel positions 106, 116 and 126 are combined and presented as a single shared spinning reel 130 which replaces a portion of all three matrices. While shared reel 130 is centered horizontally in the three matrices in this example, it may be horizontally positioned in other locations in various embodiments. The number of additional matrices and the width of the expanded reel positions may also vary in various embodiments. For example, if the matrices are r reels wide, the width of the expanded reel positions may be from r to r−1 reels wide.

Because the expanded reel positions 106, 116 and 126 are three indicia wide in the example, each indicium of reel 130 occupies nine times the space of the indicium of reels 101, 105, 111, 115, 121 and 125. For the purposes of win evaluation, each large indicium on reel 130 is treated thus as nine smaller identical indicia of the same size as the indicia on reels 101, 105, 111, 115, 121 and 125. Pay line patterns such as those illustrated in FIGS. 1F-1I may then be applied to outcome matrixes 100, 110 and 120, some examples of which are illustrated in FIGS. 1J-1K.

In some embodiments, the feature game described above is played as a primary game having two or more matrices partially replaced by a shared reel.

Figure 2:
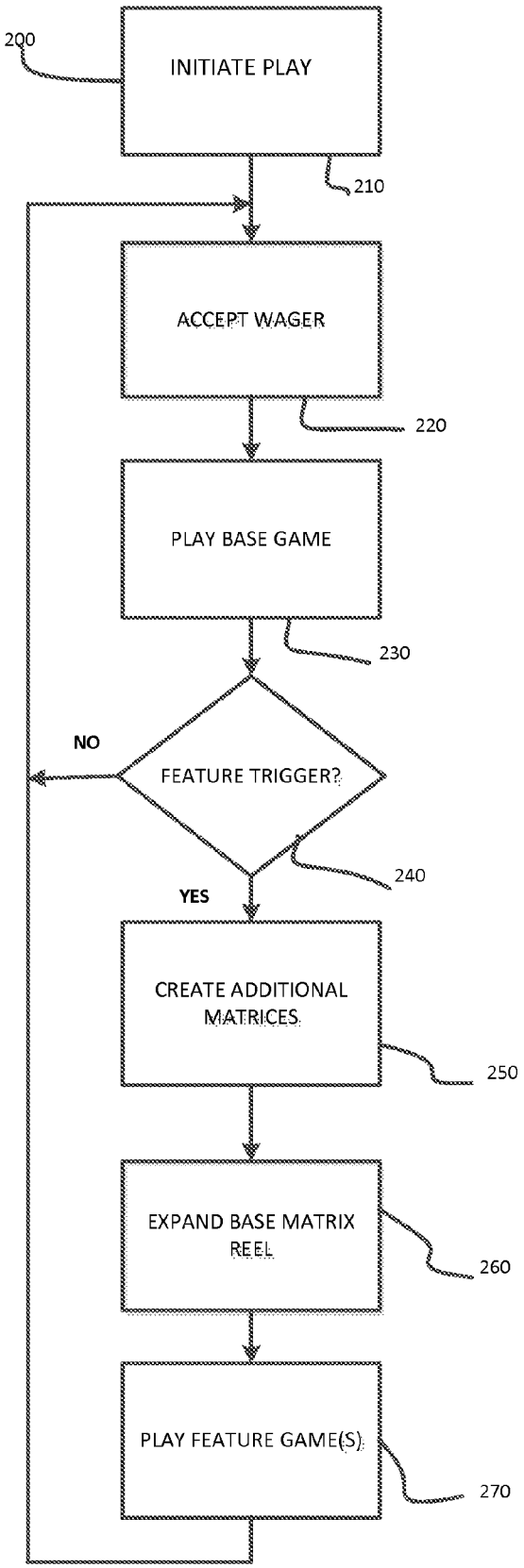
FIG. 2 illustrates a method of providing a feature game in accordance with one or more embodiments.

A logical flow diagram generally depicting the steps associated with an example method 200 for carrying out a game in accordance with one aspect of the invention is presented in FIG. 2. In one example implementation, a gaming program executable on a gaming processor may be prepared in accordance with conventional programming techniques and software to produce the desired effect as described by the blocks and flow paths in the flow diagram below. The order of actions as shown in FIG. 2 and described below is only illustrative, and should not be considered limiting. For example, the order of the actions may be changed, additional steps may be added or some steps may be removed without deviating from the scope and spirit of the invention.

In block 210, play of the game is initiated. A wager is accepted from a player at block 220 and the base game is played at block 230. For example, as described above, reels of a slot machine game may be spun and the resulting symbol combinations evaluated for any winning outcomes, which are paid to the player according to a pay table.

In decision block 240, it is determined whether a feature game has been triggered. If not, play resumes at block 220. If so, play advances to block 250, where one or more additional game matrices are created. In block 260, at least one reel of the base matrix is expanded to encompass a portion of the additional game matrices. In block 270, the feature game is played, wherein all reels of the base matrix and additional matrices except the expanded reel spin independently and wherein the expanded reel is shared by the base matrix and the additional matrices. The feature game may comprise one or more spins of the reels, after which the resulting symbol combinations are evaluated for any winning outcomes with any associated prizes paid to the player according to a pay table.

A wager for a new base game, less the expanded reel and additional matrices, is then once again accepted at block 220.

Figure 3:
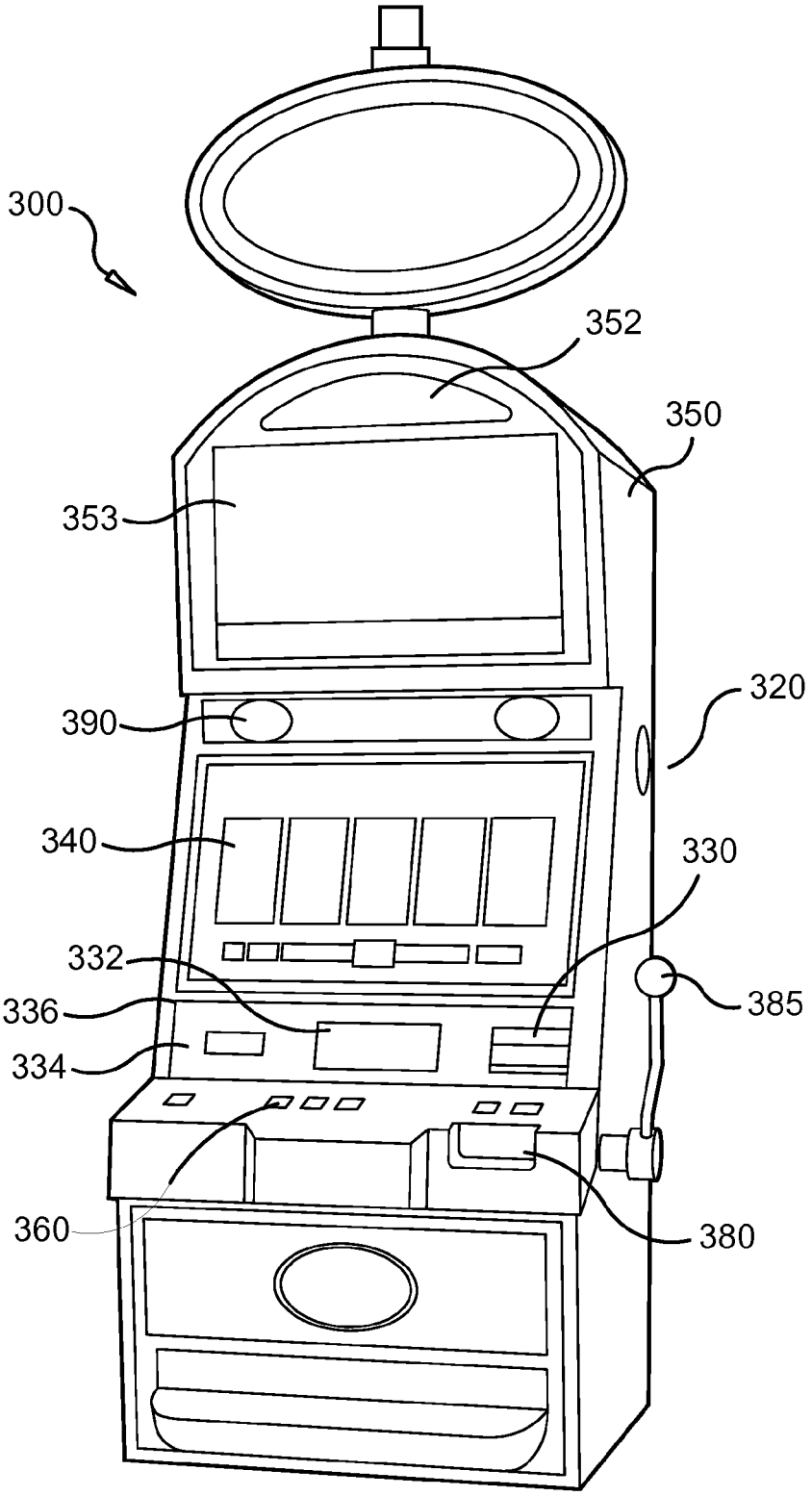
FIG. 3 is a perspective view of a gaming machine in accordance with one or more embodiments.

Referring to FIG. 3, gaming machine 300 capable of supporting various embodiments of the invention is shown, including cabinet housing 320, primary game display 340 upon which a primary game and feature game may be displayed, top box 350 which may display multiple progressives that may be won during play of the feature game, player-activated buttons 360, player tracking panel 336, bill/voucher acceptor 380 and one or more speakers 390. Cabinet housing 320 may be a self-standing unit that is generally rectangular in shape and may be manufactured with reinforced steel or other rigid materials which are resistant to tampering and vandalism. Cabinet housing 320 may alternatively be a handheld device including the gaming functionality as discussed herein and including various of the described components herein. For example, a handheld device may be a cell phone, personal data assistant, or laptop or tablet computer, each of which may include a display, a processor, and memory sufficient to support either standalone capability such as gaming machine 400 or thin client capability such as that incorporating some of the capability of a remote server.

In one or more embodiments, cabinet housing 320 houses a processor, circuitry, and software (not shown) for receiving signals from the player-activated buttons 360, operating the games, and transmitting signals to the respective displays and speakers. Any shaped cabinet may be implemented with any embodiment of gaming machine 300 so long as it provides access to a player for playing a game. For example, cabinet 320 may comprise a slant-top, bar-top, or table-top style cabinet, including a Bally Cinevision™ or CineReels™ cabinet. The operation of gaming machine 300 is described more fully below.

The plurality of player-activated buttons 360 may be used for various functions such as, but not limited to, selecting a wager denomination, selecting a game to be played, selecting a wager amount per game, initiating a game, or cashing out money from gaming machine 400. Buttons 460 may be operable as input mechanisms and may include mechanical buttons, electromechanical buttons or touch screen buttons. Optionally, a handle 385 may be rotated by a player to initiate a game.

In one or more embodiments, buttons 360 may be replaced with various other input mechanisms known in the art such as, but not limited to, a touch screen system, touch pad, track ball, mouse, switches, toggle switches, or other input means used to accept player input such as a Bally iDeck™. One other example input means is a universal button module as disclosed in U.S. application Ser. No. 11/106,212, entitled "Universal Button Module," filed on Apr. 14, 2005, which is hereby incorporated by reference. Generally, the universal button module provides a dynamic button system adaptable for use with various games and capable of adjusting to gaming systems having frequent game changes. More particularly, the universal button module may be used in connection with playing a game on a gaming machine and may be used for such functions as selecting the number of credits to bet per hand.

Cabinet housing 320 may optionally include top box 350 which contains "top glass" 352 comprising advertising or payout information related to the game or games available on gaming machine 300. Player tracking panel 336 includes player tracking card reader 334 and player tracking display 332. Voucher printer 330 may be integrated into player tracking panel 336 or installed elsewhere in cabinet housing 320 or top box 350.

Game display 340 may present a game of chance wherein a player receives one or more outcomes from a set of potential outcomes. For example, one such game of chance is a video slot machine game. In other aspects of the invention, gaming machine 300 may present a video or mechanical reel slot machine, a video keno game, a lottery game, a bingo game, a Class II bingo game, a roulette game, a craps game, a blackjack game, a mechanical or video representation of a wheel game or the like.

Mechanical or video/mechanical embodiments may include game displays such as mechanical reels, wheels, or dice as required to present the game to the player. In video/mechanical or pure video embodiments, game display 340 is, typically, a CRT or a flat-panel display in the form of, but not limited to, liquid crystal, plasma, electroluminescent, vacuum fluorescent, field emission, or any other type of panel display known or developed in the art. Game display 340 may be mounted in either a "portrait" or "landscape" orientation and be of standard or "widescreen" dimensions (i.e., a ratio of one dimension to another of at least 16×9). For example, a widescreen display may be 32 inches wide by 18 inches tall. A widescreen display in a "portrait" orientation may be 32 inches tall by 18 inches wide. Additionally, game display 440 preferably includes a touch screen or touch glass system (not shown) and presents player interfaces such as, but not limited to, credit meter (not shown), win meter (not shown) and touch screen buttons (not shown). An example of a touch glass system is disclosed in U.S. Pat. No. 6,942,571, entitled "Gaming Device with Direction and Speed Control of Mechanical Reels Using Touch Screen," which is hereby incorporated by reference in its entirety for all purposes.

Game display 340 may also present information such as, but not limited to, player information, advertisements and casino promotions, graphic displays, news and sports updates, or even offer an alternate game. This information may be generated through a host computer networked with gaming machine 300 on its own initiative or it may be obtained by request of the player using either one or more of the plurality of player-activated buttons 360; the game display itself, if game display 340 comprises a touch screen or similar technology; buttons (not shown) mounted about game display 340 which may permit selections such as those found on an ATM machine, where legends on the screen are associated with respective selecting buttons; or any player input device that offers the required functionality.

Cabinet housing 320 incorporates a single game display 340. However, in alternate embodiments, cabinet housing 320 or top box 350 may house one or more additional displays 353 or components used for various purposes including additional game play screens, animated "top glass," progressive meters or mechanical or electromechanical devices (not shown) such as, but not limited to, wheels, pointers or reels. The additional displays may or may not include a touch screen or touch glass system.

Figure 4A:
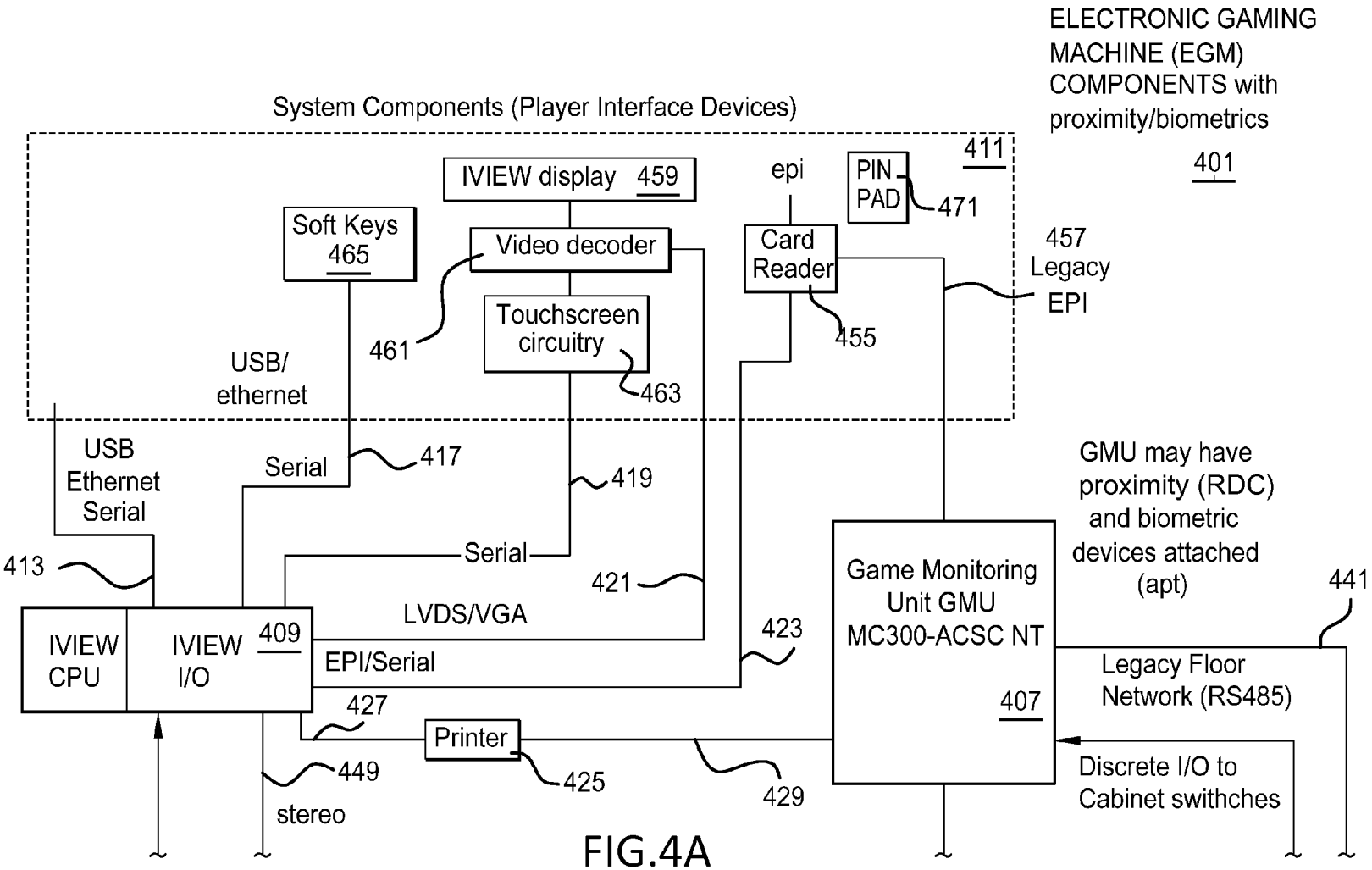
FIGS. 4A and 4B are a block diagram of the physical and logical components of the gaming machine of FIG. 3 in accordance with one or more embodiments.
Figure 4B:
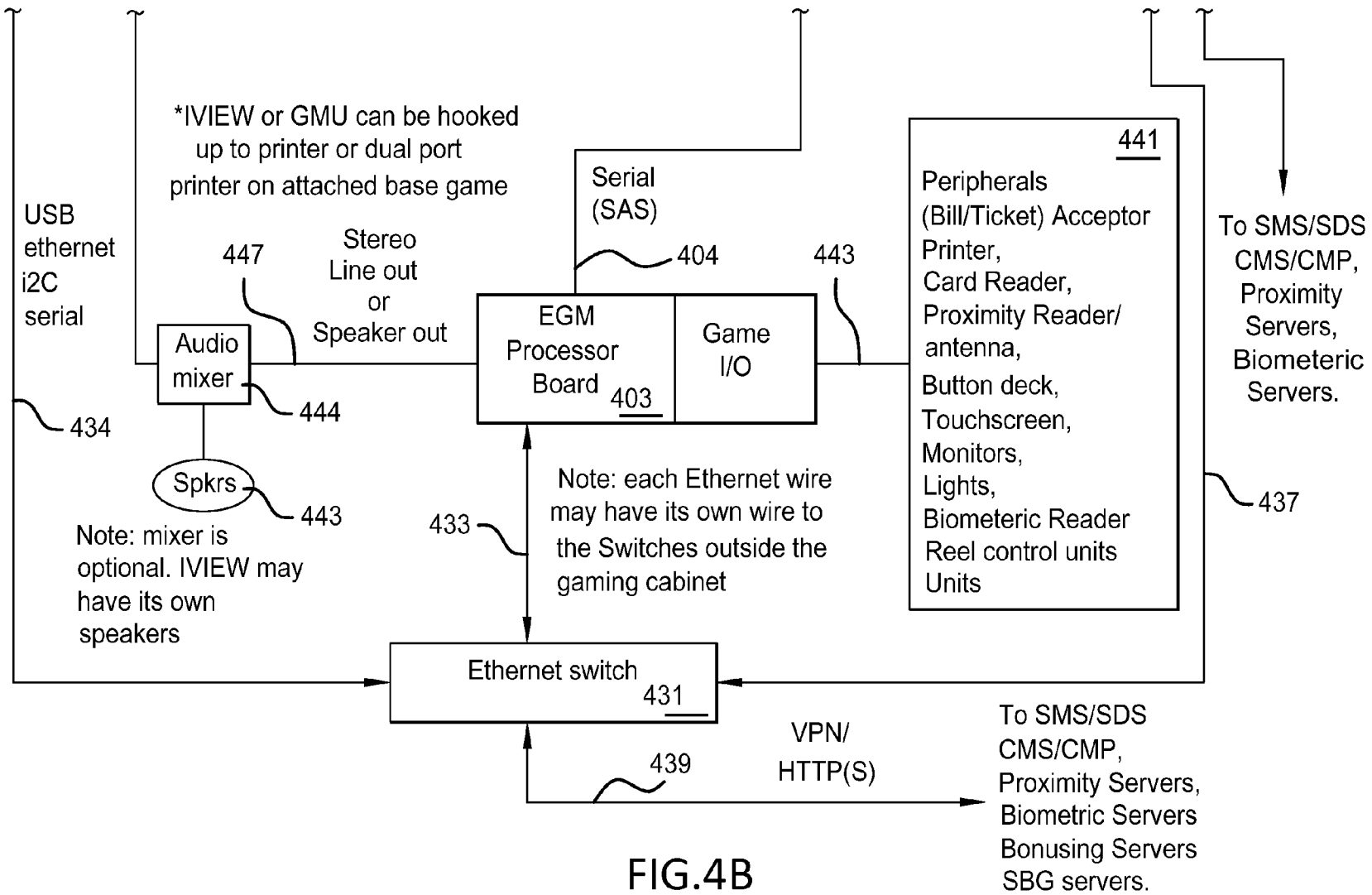

Referring to FIGS. 4A and 4B, electronic gaming machine 401 is shown in accordance with one or more embodiments. Electronic gaming machine 401 includes base game integrated circuit board 403 (EGM Processor Board) connected through serial bus line 405 to game monitoring unit (GMU) 407 (such as a Bally MC300 or ACSC NT), and player interface integrated circuit board (PIB) 409 connected to player interface devices 411 over bus lines 413, 415, 417, 419, 421, 423. Printer 425 is connected to PIB 409 and GMU 407 over bus lines 427, 429. Base game integrated circuit board 403, PIB 409, and GMU 407 connect to Ethernet switch 431 over bus lines 433, 435, 437. Ethernet switch 431 connects to a slot management system (SMS) and a casino management system (CMS) network over bus line 439. GMU 407 also may connect to the SMS and CMS network over bus line 441. Speakers 443 connect through audio mixer 445 and bus lines 447, 449 to base game integrated circuit board 403 and PIB 409. The proximity and biometric devices and circuitry may be installed by upgrading a commercially available PIB 409, such as a Bally iView unit. Coding executed on base game integrated circuit board 403, PIB 409, and/or GMU 407 may be upgraded to integrate a game according to one or more embodiments of the present invention, as is more fully described herein.

Peripherals 451 connect through I/O board 453 to base game integrated circuit board 403. For example, a bill/ticket acceptor is typically connected to a game input-output board 453 which is, in turn, connected to a conventional central processing unit ("CPU") base game integrated circuit board 403, such as an Intel Pentium microprocessor mounted on a gaming motherboard. I/O board 453 may be connected to base game integrated circuit board 403 by a serial connection such as RS-232 or USB or may be attached to the processor by a bus such as, but not limited to, an ISA bus. The gaming motherboard may be mounted with other conventional components, such as are found on conventional personal computer motherboards, and loaded with a game program which may include a gaming machine operating system (OS), such as a Bally Alpha OS. Base game integrated circuit board 403 executes a game program that causes base game integrated circuit board 403 to play a game. In one embodiment, the game program provides a slot machine game having adjustable multi-part indicia. The various components and included devices may be installed with conventionally and/or commercially available components, devices, and circuitry into a conventional and/or commercially available gaming machine cabinet, examples of which are described above.

When a player has inserted a form of currency such as, for example and without limitation, paper currency, coins or tokens, cashless tickets or vouchers, electronic funds transfers or the like into the currency acceptor, a signal is sent by way of I/O board 453 to base game integrated circuit board 403 which, in turn, assigns an appropriate number of credits for play in accordance with the game program. The player may further control the operation of the gaming machine by way of other peripherals 451, for example, to select the amount to wager via electromechanical or touch screen buttons. The game starts in response to the player operating a start mechanism such as a handle or touch screen icon. The game program includes a random number generator to provide a display of randomly selected indicia on one or more displays. In some embodiments, the random generator may be physically separate from gaming machine 400; for example, it may be part of a central determination host system which provides random game outcomes to the game program. Thereafter, the player may or may not interact with the game through electromechanical or touch screen buttons to change the displayed indicia. Finally, base game integrated circuit board 403 under control of the game program and OS compares the final display of indicia to a pay table. The set of possible game outcomes may include a subset of outcomes related to the triggering of a feature game. In the event the displayed outcome is a member of this subset, base game integrated circuit board 403, under control of the game program and by way of I/O Board 453, may cause feature game play to be presented on a feature display.

Predetermined payout amounts for certain outcomes, including feature game outcomes, are stored as part of the game program. Such payout amounts are, in response to instructions from base game integrated circuit board 403, provided to the player in the form of coins, credits or currency via I/O board 453 and a pay mechanism, which may be one or more of a credit meter, a coin hopper, a voucher printer, an electronic funds transfer protocol or any other payout means known or developed in the art.

In various embodiments, the game program is stored in a memory device (not shown) connected to or mounted on the gaming motherboard. By way of example, but not by limitation, such memory devices include external memory devices, hard drives, CD-ROMs, DVDs, and flash memory cards. In an alternative embodiment, the game programs are stored in a remote storage device. In one embodiment, the remote storage device is housed in a remote server. The gaming machine may access the remote storage device via a network connection, including but not limited to, a local area network connection, a TCP/IP connection, a wireless connection, or any other means for operatively networking components together. Optionally, other data including graphics, sound files and other media data for use with the EGM are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the EGM using USB, serial or Ethernet connections. Each of the respective devices may have upgrades to their firmware utilizing these connections.

GMU 407 includes an integrated circuit board and GMU processor and memory including coding for network communications, such as the G2S (game-to-system) protocol from the Gaming Standards Association, Las Vegas, Nev., used for system communications over the network. As shown, GMU 407 may connect to card reader 455 through bus 457 and may thereby obtain player card information and transmit the information over the network through bus 441. Gaming activity information may be transferred by the base game integrated circuit board 403 to GMU 407 where the information may be translated into a network protocol, such as S2S, for transmission to a server, such as a player tracking server, where information about a player's playing activity may be stored in a designated server database.

PIB 409 includes an integrated circuit board, PID processor, and memory which includes an operating system, such as Windows CE, a player interface program which may be executable by the PID processor together with various input/output (I/O) drivers for respective devices which connect to PIB 409, such as player interface devices 411, and which may further include various games or game components playable on PIB 409 or playable on a connected network server and PIB 409 is operable as the player interface. PIB 409 connects to card reader 455 through bus 423, display 459 through video decoder 461 and bus 421, such as an LVDS or VGA bus.

As part of its programming, the PID processor executes coding to drive display 459 and provide messages and information to a player. Touch screen circuitry interactively connects display 459 and video decoder 461 to PIB 409, such that a player may input information and cause the information to be transmitted to PIB 409 either on the player's initiative or responsive to a query by PIB 409. Additionally soft keys 465 connect through bus 417 to PIB 409 and operate together with display 459 to provide information or queries to a player and receive responses or queries from the player. PIB 409, in turn, communicates over the CMS/SMS network through Ethernet switch 431 and busses 435, 439 and with respective servers, such as a player tracking server.

Player interface devices 411 are linked into the virtual private network of the system components in gaming machine 401. The system components include the iView processing board and game monitoring unit (GMU) processing board. These system components may connect over a network to the slot management system (such as a commercially available Bally SDS/SMS) and/or casino management system (such as a commercially available Bally CMP/CMS).

The GMU system component has a connection to the base game through a serial SAS connection and is connected to various servers using, for example, HTTPs over Ethernet. Through this connection, firmware, media, operating system software, gaming machine configurations can be downloaded to the system components from the servers. This data is authenticated prior to install on the system components.

The system components include the iView processing board and game monitoring unit (GMU) processing board. The GMU and iView can combined into one like the commercially available Bally GTM iView device. This device may have a video mixing technology to mix the EGM processor's video signals with the iView display onto the top box monitor or any monitor on the gaming device.

Figure 5:
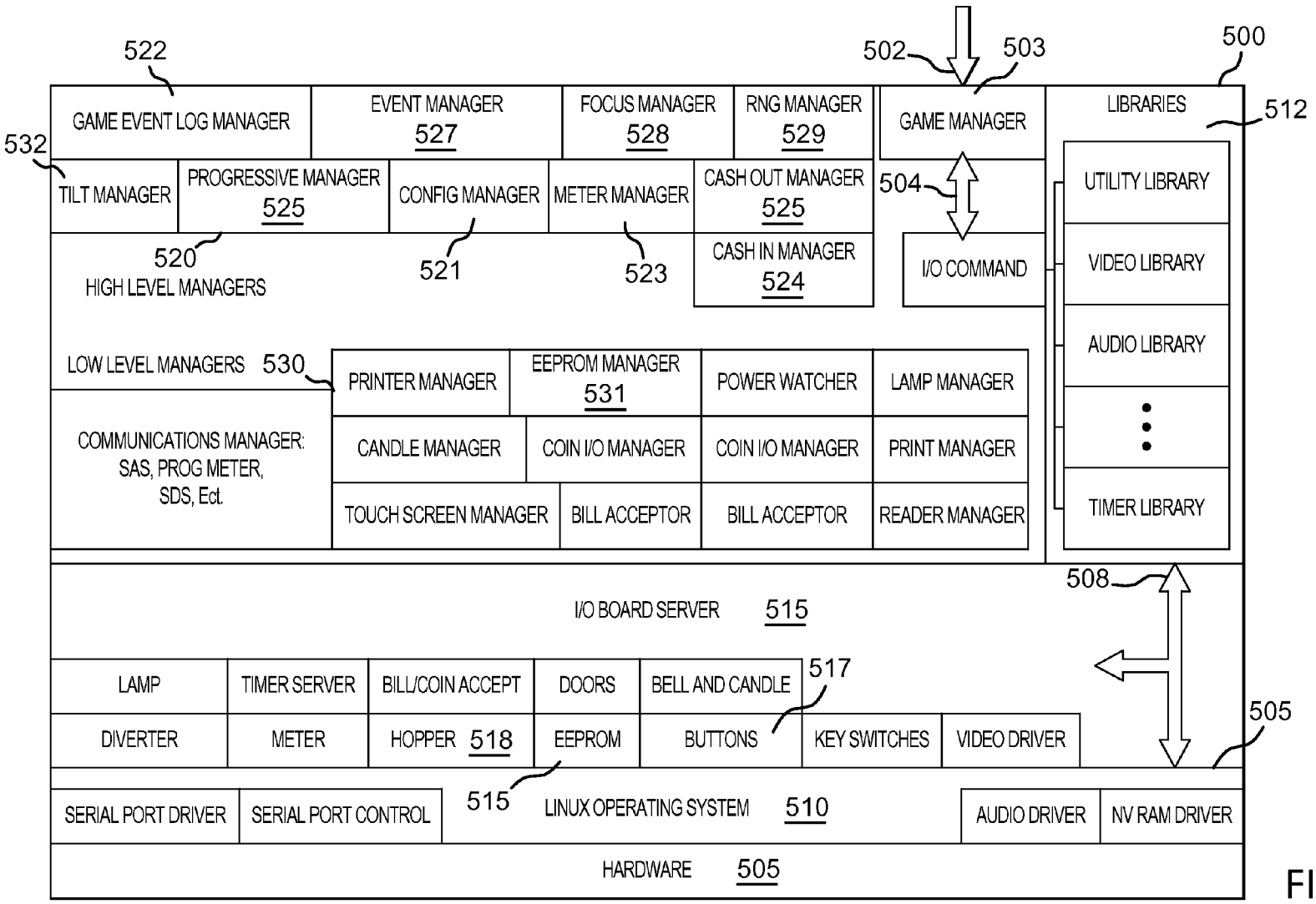
FIG. 5 is a block diagram of the logical components of a gaming kernel in accordance with one or more embodiments.

In accordance with one or more embodiments, FIG. 5 is a functional block diagram of a gaming kernel 500 of a game program under control of base game integrated circuit board 403. The game program uses gaming kernel 500 by calling into application programming interface (API) 502, which is part of game manager 503. The components of game kernel 500 as shown in FIG. 5 are only illustrative, and should not be considered limiting. For example, the number of managers may be changed, additional managers may be added or some managers may be removed without deviating from the scope and spirit of the invention.

As shown in the example, there are three layers: a hardware layer 505; an operating system layer 510, such as, but not limited to, Linux; and a game kernel layer 500 having game manager 503 therein. In one or more embodiments, the use of a standard operating system 510, such a UNIX-based or Windows-based operating system, allows game developers interfacing to the gaming kernel to use any of a number of standard development tools and environments available for the operating systems. This is in contrast to the use of proprietary, low level interfaces which may require significant time and engineering investments for each game upgrade, hardware upgrade, or feature upgrade. The game kernel layer 500 executes at the user level of the operating system 510, and itself contains a major component called the I/O Board Server 515. To properly set the bounds of game application software (making integrity checking easier), all game applications interact with gaming kernel 500 using a single API 502 in game manager 503. This enables game applications to make use of a well-defined, consistent interface, as well as making access points to gaming kernel 500 controlled, where overall access is controlled using separate processes.

For example, game manager 503 parses an incoming command stream and, when a command dealing with I/O comes in (arrow 504), the command is sent to an applicable library routine 512. Library routine 512 decides what it needs from a device, and sends commands to I/O Board Server 515 (see arrow 508). A few specific drivers remain in operating system 510's kernel, shown as those below line 506. These are built-in, primitive, or privileged drivers that are (i) general (ii) kept to a minimum and (iii) are easier to leave than extract. In such cases, the low-level communications is handled within operating system 510 and the contents passed to library routines 512.

Thus, in a few cases library routines may interact with drivers inside operating system 510, which is why arrow 508 is shown as having three directions (between library utilities 512 and I/O Board Server 515, or between library utilities 512 and certain drivers in operating system 510). No matter which path is taken, the logic needed to work with each device is coded into modules in the user layer of the diagram. Operating system 510 is kept as simple, stripped down, and common across as many hardware platforms as possible. The library utilities and user-level drivers change as dictated by the game cabinet or game machine in which it will run. Thus, each game cabinet or game machine may have an base game integrated circuit board 403 connected to a unique, relatively dumb, and as inexpensive as possible I/O adapter board 440, plus a gaming kernel 500 which will have the game-machine-unique library routines and I/O Board Server 515 components needed to enable game applications to interact with the gaming machine cabinet. Note that these differences are invisible to the game application software with the exception of certain functional differences (i.e., if a gaming cabinet has stereo sound, the game application will be able make use of API 502 to use the capability over that of a cabinet having traditional monaural sound).

Game manager 503 provides an interface into game kernel 500, providing consistent, predictable, and backwards compatible calling methods, syntax, and capabilities by way of game application API 502. This enables the game developer to be free of dealing directly with the hardware, including the freedom to not have to deal with low-level drivers as well as the freedom to not have to program lower level managers 530, although lower level managers 630 may be accessible through game manager 503's interface 502 if a programmer has the need. In addition to the freedom derived from not having to deal with the hardware level drivers and the freedom of having consistent, callable, object-oriented interfaces to software managers of those components (drivers), game manager 503 provides access to a set of upper level managers 520 also having the advantages of consistent callable, object-oriented interfaces, and further providing the types and kinds of base functionality required in casino-type games. Game manager 503, providing all the advantages of its consistent and richly functional interface 502 as supported by the rest of game kernel 500, thus provides a game developer with a multitude of advantages.

Game manager 503 may have several objects within itself, including an initialization object (not shown). The initialization object performs the initialization of the entire game machine, including other objects, after game manager 503 has started its internal objects and servers in appropriate order. In order to carry out this function, the kernel's configuration manager 521 is among the first objects to be started; configuration manager 521 has data needed to initialize and correctly configure other objects or servers.

The upper level managers 520 of game kernel 500 may include game event log manager 522 which provides, at the least, a logging or logger base class, enabling other logging objects to be derived from this base object. The logger object is a generic logger; that is, it is not aware of the contents of logged messages and events. The log manager's (1622) job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 523 manages the various meters embodied in the game kernel 500. This includes the accounting information for the game machine and game play. There are hard meters (counters) and soft meters; the soft meters may be stored in non-volatile storage such as non-volatile battery-backed RAM to prevent loss. Further, a backup copy of the soft meters may be stored in a separate non-volatile storage such as EEPROM. In one embodiment, meter manager 523 receives its initialization data for the meters, during start-up, from configuration manager 521. While running, the cash in (1624) and cash out (1625) managers call the meter manager's (1623) update functions to update the meters. Meter manager 523 will, on occasion, create backup copies of the soft meters by storing the soft meters' readings in EEPROM. This is accomplished by calling and using EEPROM manager 531.

In accordance with still other embodiments, progressive manager 526 manages progressive games playable from the game machine. Event manager 527 is generic, like log manager 522, and is used to manage various gaming machine events. Focus manager 628 correlates which process has control of various focus items. Tilt manager 532 is an object that receives a list of errors (if any) from configuration manager 521 at initialization, and during game play from processes, managers, drivers, etc. that may generate errors. Random number generator manager 529 is provided to allow easy programming access to a random number generator (RNG), as a RNG is required in virtually all casino-style (gambling) games. RNG manager 529 includes the capability of using multiple seeds.

In accordance with one or more embodiments, a credit manager object (not shown) manages the current state of credits (cash value or cash equivalent) in the game machine, including any available winnings, and further provides denomination conversion services. Cash out manager 525 has the responsibility of configuring and managing monetary output devices. During initialization, cash out manager 525, using data from configuration manager 521, sets the cash out devices correctly and selects any selectable cash out denominations. During play, a game application may post a cash out event through the event manager 527 (the same way all events are handled), and using a call-back posted by cash out manager 525, cash out manager 525 is informed of the event. Cash out manager 525 updates the credit object, updates its state in non-volatile memory, and sends an appropriate control message to the device manager that corresponds to the dispensing device. As the device dispenses dispensable media, there will typically be event messages being sent back and forth between the device and cash out manager 525 until the dispensing finishes, after which cash out manager 525, having updated the credit manager and any other game state (such as some associated with meter manager 523) that needs to be updated for this set of actions, sends a cash out completion event to event manager 527 and to the game application thereby. Cash in manager 624 functions similarly to cash out manager 525, only controlling, interfacing with, and taking care of actions associated with cashing in events, cash in devices, and associated meters and crediting.

In a further example, in accordance with one or more embodiments, I/O server 515 may write data to the gaming machine EEPROM memory, which is located in the gaming machine cabinet and holds meter storage that must be kept even in the event of power failure. Game manager 503 calls the I/O library functions to write data to the EEPROM. The I/O server 515 receives the request and starts a low priority EEPROM thread 516 within I/O server 515 to write the data. This thread uses a sequence of 8 bit command and data writes to the EEPROM device to write the appropriate data in the proper location within the device. Any errors detected will be sent as IPC messages to game manager 503. All of this processing is asynchronous.

In accordance with one embodiment, button module 517 within I/O server 515, polls (or is sent) the state of buttons every 2 ms. These inputs are debounced by keeping a history of input samples. Certain sequences of samples are required to detect a button was pressed, in which case the I/O server 515 sends an inter-process communication event to game manager 503 that a button was pressed or released. In some embodiments, the gaming machine may have intelligent distributed I/O which debounces the buttons, in which case button module 517 may be able to communicate with the remote intelligent button processor to get the button events and simply relay them to game manager 503 via IPC messages. In still another embodiment, the I/O library may be used for pay out requests from the game application. For example, hopper module 518 must start the hopper motor, constantly monitor the coin sensing lines of the hopper, debounce them, and send an IPC message to the game manager 503 when each coin is paid.

Further details, including disclosure of lower level fault handling and/or processing, are included in U.S. Pat. No. 7,351,151 entitled "Gaming Board Set and Gaming Kernel for Game Cabinets" and provisional U.S. patent application No. 60/313,743, entitled "Form Fitting Upgrade Board Set For Existing Game Cabinets," filed Aug. 20, 2001; said patent and provisional are both fully incorporated herein by explicit reference.

Figure 6A:
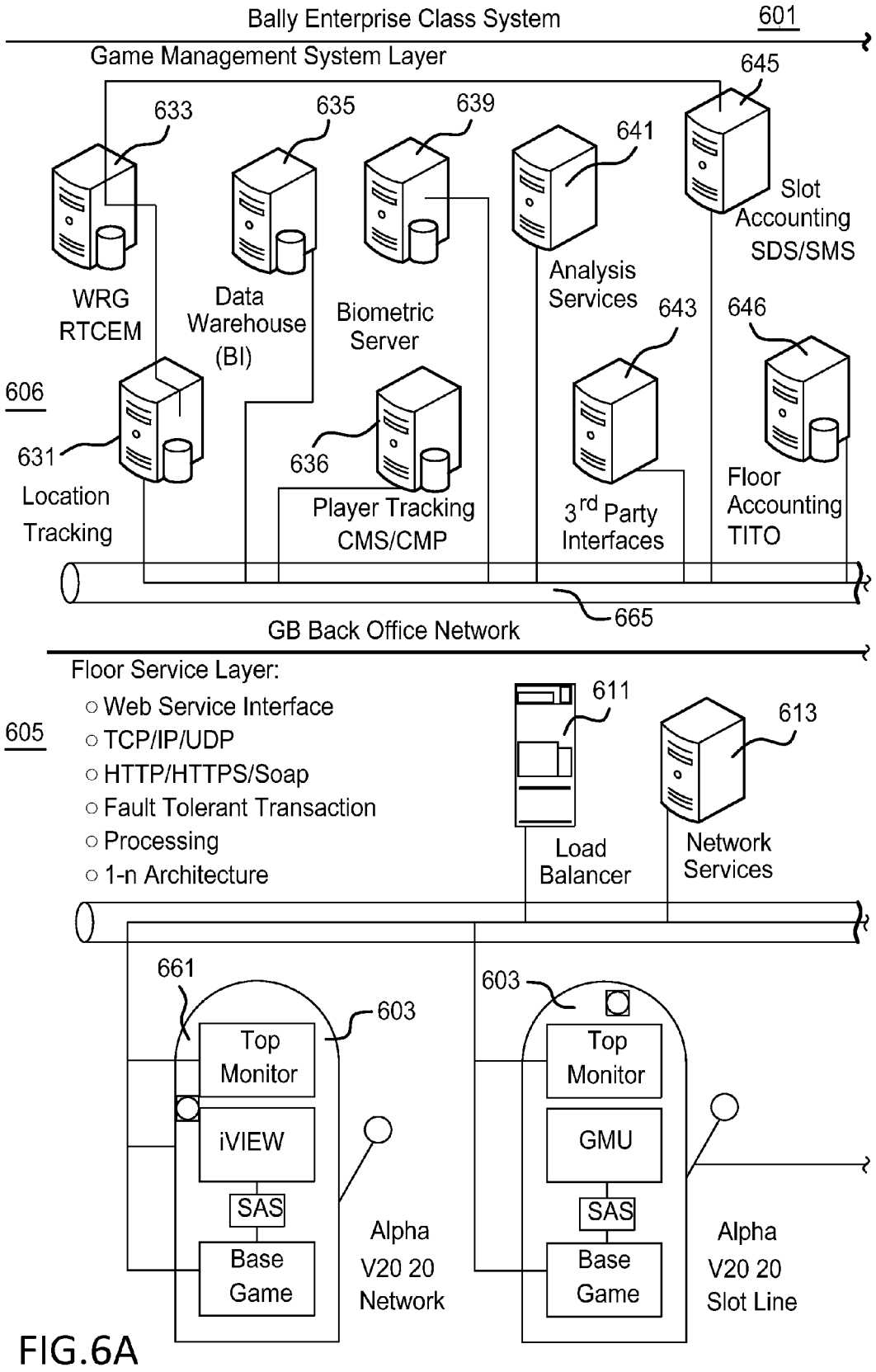
FIGS. 6A and 6B are a schematic block diagram showing the hardware elements of a networked gaming system in accordance with one or more embodiments.
Figure 6B:
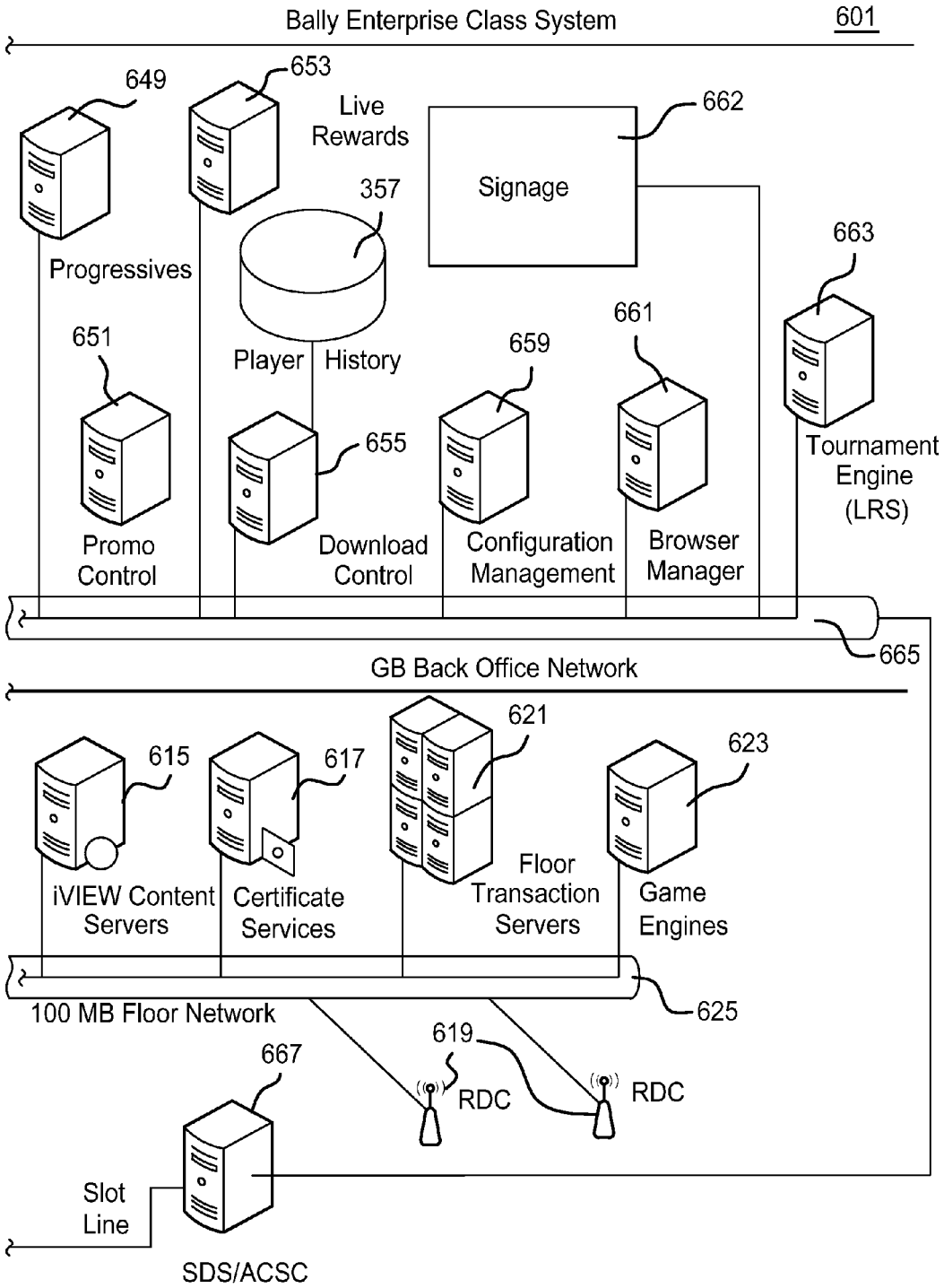

Referring to FIGS. 6A and 6B, enterprise gaming system 601 is shown in accordance with one or more embodiments. Enterprise gaming system 601 may include one casino or multiple locations and generally includes a network of gaming machines 603, floor management system (SMS) 605, and casino management system (CMS) 607. SMS 605 may include load balancer 611, network services servers 613, player interface (iView) content servers 615, certificate services server 617, floor radio dispatch receiver/transmitters (RDC) 619, floor transaction servers 621 and game engines 623, each of which may connect over network bus 625 to gaming machines 603. CMS 607 may include location tracking server 631, WRG RTCEM server 633, data warehouse server 635, player tracking server 637, biometric server 639, analysis services server 641, third party interface server 643, slot accounting server 645, floor accounting server 647, progressives server 649, promo control server 651, feature game (such as Bally Live Rewards) server 653, download control server 655, player history database 657, configuration management server 659, browser manager 661, tournament engine server 663 connecting through bus 665 to server host 667 and gaming machines 603. The various servers and gaming machines 603 may connect to the network with various conventional network connections (such as, for example, USB, serial, parallel, RS485, Ethernet). Additional servers which may be incorporated with CMS 607 include a responsible gaming limit server (not shown), advertisement server (not shown), and a control station server (not shown) where an operator or authorized personnel may select options and input new programming to adjust each of the respective servers and gaming machines 603. SMS 605 may also have additional servers including a control station (not shown) through which authorized personnel may select options, modify programming, and obtain reports of the connected servers and devices, and obtain reports. The various CMS and SMS servers are descriptively entitled to reflect the functional executable programming stored thereon and the nature of databases maintained and utilized in performing their respective functions.

Gaming machines 603 include various peripheral components that may be connected with USB, serial, parallel, RS-485 or Ethernet devices/architectures to the system components within the respective gaming machine. The GMU has a connection to the base game through a serial SAS connection. The system components in the gaming cabinet may be connected to the servers using HTTPs or G2S over Ethernet. Using CMS 607 and/or SMS 605 servers and devices, firmware, media, operating systems, and configurations may be downloaded to the system components of respective gaming machines for upgrading or managing floor content and offerings in accordance with operator selections or automatically depending upon CMS 607 and SMS 605 master programming. The data and programming updates to gaming machines 603 are authenticated using conventional techniques prior to install on the system components.

In various embodiments, any of the gaming machines 603 may be a mechanical reel spinning slot machine or a video slot machine or a gaming machine offering one or more of the above described games including a group play game. Alternately, gaming machines 603 may provide a game with a simulated musical instrument interface as a primary or base game or as one of a set of multiple primary games selected for play by a random number generator. A gaming system of the type described above also allows a plurality of games in accordance with the various embodiments of the invention to be linked under the control of a group game server (not shown) for cooperative or competitive play in a particular area, carousel, casino or between casinos located in geographically separate areas. For example, one or more examples of group games under control of a group game server are disclosed in U.S. application Ser. No. 11/938,079, entitled "Networked System and Method for Group Play Gaming," filed on Nov. 9, 2007, which is hereby incorporated by reference in its entirety for all purposes.

Figure 7:
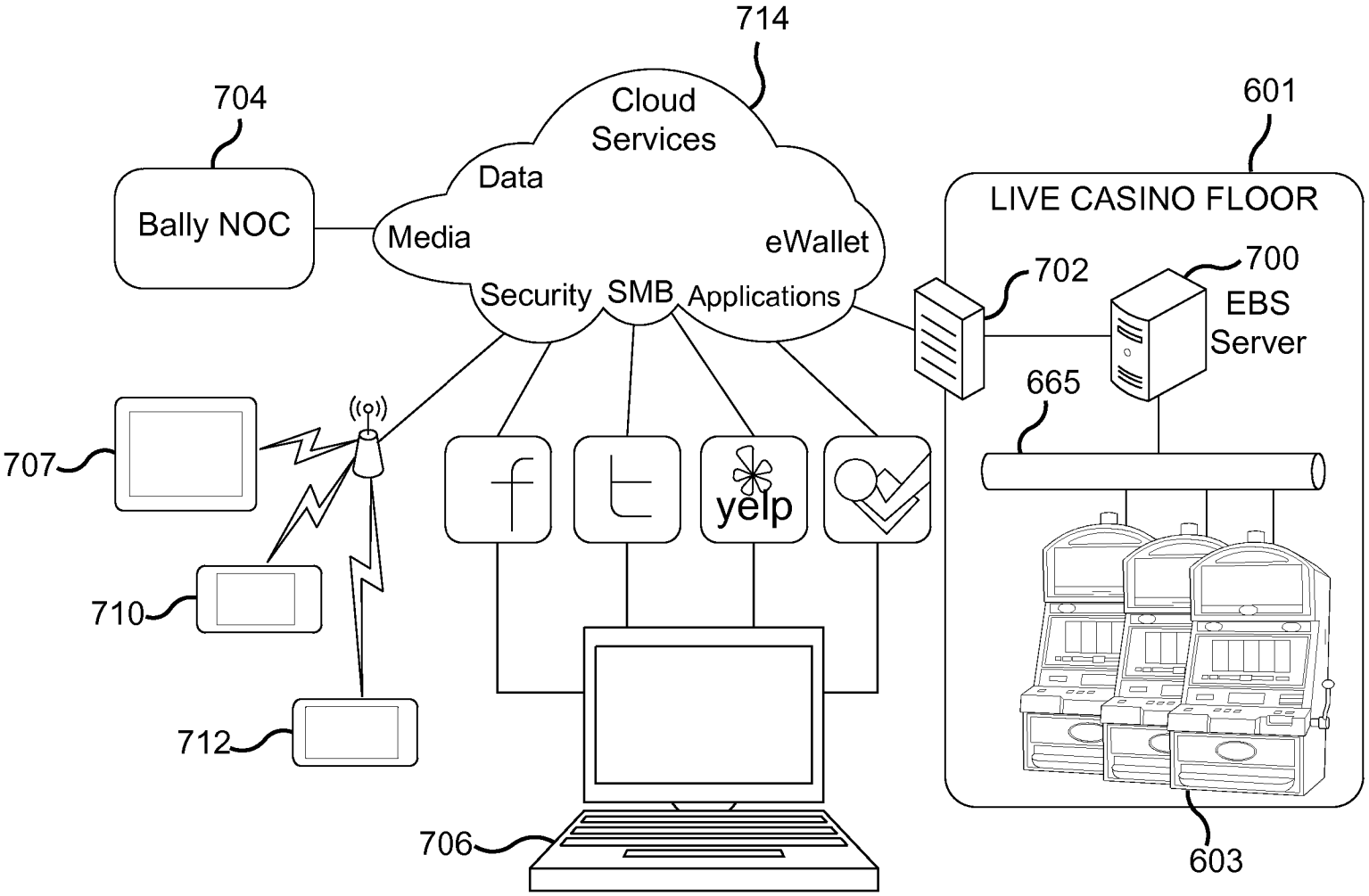
FIG. 7 is a diagram showing an example of an architecture for tying a casino enterprise network to an external provider of games and content to Internet or broadband communication capable devices.

All or portions of the present invention may also be implemented or promoted by or through a system as suggested in FIG. 7. At 601 is the gaming system of FIGS. 6A and 6B, which may be hosted at a casino property enterprise, across several casino enterprises or by a third party host. As described above, the gaming system 601 has a network communication bus 665 providing for communication between the gaming terminals 603 and various servers. To provide the functionality illustrated in FIG. 7, a bonusing server 700, such as a Bally Elite Bonusing Server is connected to the network communication bus 665 (FIGS. 6A and 6B) for communication to the gaming system 601, the gaming terminals 603 and the various servers and other devices as described above. Through a secure network firewall 702 the bonusing server 700 is in communication with a cloud computing/storage service 704 which may be hosted by the casino enterprise, a licensed third party or if permitted by gaming regulators an unlicensed provider. For example the cloud service 704 may be as provided by Microsoft® Private Cloud Solutions offered by Microsoft Corp. of Redmond, Wash., USA. The cloud service 704 provides various applications which can be accessed and delivered to, for example, personal computers 706, portable computing devices such as computer tablets 708, personal digital assistants (PDAs) 710 and cellular devices 712 such as telephones and smart phones. As but an example, the cloud service 704 may store and host an eWallet application, casino or player-centric applications such as downloadable or accessible applications including games, promotional material or applications directed to and/or affecting a casino customers interaction with a casino enterprise (such as accessing the players casino account, establishing casino credit or the like), providing bonuses to players through system wide bonusing (SMB) or specific bonusing or comps to players, or other applications. The cloud service 704 includes security provide for secure communication with the cloud service 704 between the player/users and the cloud service 704 and between the cloud service 704 and the gaming system 601. Security applications may be through encryption, the use of personal identification numbers (PINS) or other devices and systems. As suggested in FIG. 7, the cloud service 714 stores player/user data retrieved from players/users and from the gaming system 601.

The players/users may access the cloud service 704 and the applications and data provided thereby through the Internet or through broadband wireless cellular communication systems and any intervening sort range wireless communication such as WiFi. The players/users may access the applications and data through various social media offerings such as Facebook, Twitter, Yelp, MySpace, LinkedIn or the like.

As but an example, a player/user may have a player account with a casino enterprise Z. That account may include data such as the player's credit level, their rating and their available comps. The account may further track any certificates, and the present value thereof, the player may have won as a result of the playing a game according to the present invention. At their smart phone 712 the player/user sends a request to the clout service 704 (perhaps through a previously downloaded application) to request the status of their available comps such as how many comp points they have and what may be available through redemption of those points (e.g. lodging, cash back, meals or merchandise). The application for the request may present casino promotions, graphics or other advertising to the player/user. The application, to support such a request, would typically require the player/user to enter a PIN. The cloud service 1004 forwards the inquiry to the bonusing servicer 700 which, in turn, confirms the PIN and retrieves the requested information from the data warehouse 635 (FIGS. 6A & 6B) or player tracking CMS/CMP server 637 (FIGS. 6A & 6B). Alternatively the data may be stored in the cloud service 704 and routinely updated from the data warehouse 635 or player tracking CMS/CMP server 637. In this instance the request would be responded to from data residing with the cloud service 704. The information is formatted by the cloud server 704 application and delivered to the player/user. The delivery may be formatted based upon the player/user's device operating system (OS), display size or the like.

The cloud service 700 may also host game applications to provide virtual instances of games for free, promotional, or where permitted, P2P (Pay to Play) supported gaming. Third party developers may also have access to placing applications with the cloud service 704 through, for example a national operations center (Bally NOC 714). A game software manufacturer such as Bally Gaming, Inc. may also provide game applications on its own or on behalf of the casino enterprise.

Other media such as advertising, notices (such as an upcoming tournament) may also be provided to the cloud service 704. When a player/user accesses the cloud service 704 certain media may be delivered to the player/user in a manner formatted for their application and device.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A gaming device comprising:

one or more electronic input devices;

game-logic circuitry configured to:

detect, via at least one of the one or more electronic input devices, a physical item associated with a monetary value that establishes a credit balance;

initiate a casino wagering game in response to an initiation input indicative of a wager covered by the credit balance;

spin or appear to spin a first plurality of indicia-bearing reels to produce an outcome in a first game matrix;

upon a triggering event, initiate at least one feature game and spin or appear to spin a second plurality of indicia-bearing reels to produce an outcome in a second game matrix wherein a single expanded reel replaces at least part of the first game matrix and the second game matrix and is spun or appears to spin to simultaneously produce an outcome in both the first game matrix and the second game matrix; and receive via at least one of the one or more electronic input devices, a cashout input hat initiates a payout from the credit balance.

2. The gaming device of claim 1, wherein the indicia of the first plurality of indicia-bearing reels and the indicia of the second plurality of indicia-bearing reels comprise a first height and wherein, upon being combined to form the single expanded reel, the indicia of the single expanded indicia-bearing reel comprises a second height.

3. The gaming device of claim 1 wherein different pay line patterns are associated with the first game matrix and the second game matrix.

4. The gaming device of claim 1 further comprising a third plurality of indicia-bearing reels which are spun or appear to spin to produce an outcome in a third game matrix; wherein the single expanded reel replaces at least part of the third game matrix and is spun or appears to spin to simultaneously produce an outcome in both the first game matrix and the third game matrix.

5. The gaming device of claim 4, wherein different pay line patterns are associated with the first game matrix and the third game matrix.

6. The gaming device of claim 1, wherein the width of the single expanded reel is calculated as at least 1 times r and less than or equal to r−1, where r is the number of reels in the first plurality of reels.

* * * * *